US007779627B1

(12) United States Patent
Ries

(10) Patent No.: US 7,779,627 B1
(45) Date of Patent: Aug. 24, 2010

(54) VARIABLE-DISPLACEMENT PISTON-CYLINDER DEVICE

(76) Inventor: James D. Ries, 244 Little Station Rd., Holland, MI (US) 49424

( * ) Notice: Subject to any disclaimer, the term of this patent is extended or adjusted under 35 U.S.C. 154(b) by 0 days.

(21) Appl. No.: 12/366,295

(22) Filed: Feb. 5, 2009

(51) Int. Cl.
*F04B 23/00* (2006.01)
*F02B 75/32* (2006.01)

(52) U.S. Cl. ..... 60/325; 123/198 F

(58) Field of Classification Search ..... 60/325; 123/58.5, 58.6, 73 F, 65 S, 198 F
See application file for complete search history.

(56) References Cited

U.S. PATENT DOCUMENTS 0,877,483 A 1/1908 Boyer
0,958,583 A 5/1910 Borden
1,067,484 A 7/1913 Nickel et al.
1,383,536 A 7/1921 Davies
1,592,311 A 7/1926 Porsche
1,737,976 A 12/1929 Rice, Jr.
2,230,308 A * 2/1941 Olds ..... 123/58.6
2,241,957 A 5/1941 Pescara
2,358,797 A 9/1944 Evans
3,190,545 A 6/1965 Weber et al.
3,200,249 A 8/1965 Janicke
4,068,629 A * 1/1978 Hooper ..... 123/65 S
4,210,108 A 7/1980 Hooper
4,522,163 A 6/1985 Hooper
4,627,795 A 12/1986 Schmitz-Montz
4,657,488 A 4/1987 Weinhandl
4,672,931 A 6/1987 Biagini
4,705,460 A 11/1987 Braun
4,836,093 A 6/1989 Wagner
5,027,757 A 7/1991 Pusic
5,189,995 A 3/1993 Hooper
5,515,685 A 5/1996 Yanai et al.
5,522,223 A 6/1996 Yanai et al.
5,676,104 A 10/1997 Chatelain
5,716,197 A * 2/1998 Paul et al. ..... 60/659
5,769,040 A 6/1998 Christner et al.
5,782,612 A 7/1998 Margardt (Continued)

OTHER PUBLICATIONS

Website entitled "Stepped Piston Operating Principle" by Bernard Hooper Engineering Ltd., Shropshire, England, available at http://users.breathe.com/prhooper/opads.htem, published on or before Sep. 28, 2008.

(Continued)

*Primary Examiner*—Thomas E Lazo
(74) *Attorney, Agent, or Firm*—Van Dyke, Gardner, Linn & Burkhart, LLP

(57) ABSTRACT

A variable-displacement piston-cylinder device may be adapted for providing work output, and/or for pumping or compressing fluids. The piston-cylinder device defines two or more coaxial cylindrical expansion chambers between a piston having two or more coaxial and conjoined piston members, and a correspondingly-shaped cylinder. Substantially any combination of the expansion chambers may be activated or deactivated in order to vary the effective displacement of the piston-cylinder device. The effective displacement of each piston-cylinder may be changed in mid-operation in order to reduce power output and fuel consumption (or pumping or compressing capacity), without introducing vibration. In addition, a control system is provided for managing the effective displacement of each piston-cylinder according to output required, desirable operating parameters, and other parameters that can effect the operation of the device.

33 Claims, 12 Drawing Sheets

U.S. PATENT DOCUMENTS

| | | | | |
|---|---|---|---|---|
| 5,797,359 | A | 8/1998 | Freeman | |
| 5,857,450 | A | 1/1999 | Staerzl | |
| 6,065,440 | A * | 5/2000 | Pasquan | 123/198 F |
| 6,074,018 | A | 6/2000 | Zeiner et al. | |
| 6,079,796 | A | 6/2000 | Schmidt et al. | |
| 6,158,812 | A | 12/2000 | Bonke | |
| 6,209,563 | B1 | 4/2001 | Seid et al. | |
| 6,289,856 | B1 | 9/2001 | Noguchi | |
| 6,302,663 | B1 | 10/2001 | Schuller et al. | |
| 6,321,767 | B1 | 11/2001 | Seid et al. | |
| 6,446,435 | B1 | 9/2002 | Willmann et al. | |
| 6,457,956 | B1 | 10/2002 | Hauser et al. | |
| 6,581,634 | B2 | 6/2003 | Najmolhoda et al. | |
| 6,598,512 | B2 | 7/2003 | Siegel | |
| 6,615,186 | B1 | 9/2003 | Kolls | |
| 6,648,614 | B1 | 11/2003 | Hinz et al. | |
| 6,786,232 | B2 | 9/2004 | Schuller et al. | |
| 6,955,151 | B2 * | 10/2005 | Naljotov et al. | 123/61 R |
| 7,204,565 | B2 | 4/2007 | Hinz et al. | |
| 2005/0025636 | A1 | 2/2005 | Durr | |

OTHER PUBLICATIONS

V.W. Wong, et al., "Increased Power Density via Variable Compression/Displacement and Turbocharging Using the Alvar-Cycle Engine," SAE Technical Paper 981027, USA, published 1998.

Paul A. Russo, et al. "A Variable Displacement Engine with Independently Controllable Stroke Length and Compression Ratio," SAE Technical Paper 2006-01-0741, USA, published 2006.

* cited by examiner

VARIABLE-DISPLACEMENT PISTON-CYLINDER DEVICE

FIELD OF THE INVENTION

The present invention relates generally to piston-cylinder devices, and in particular, to piston-cylinder devices for engine, pumping, and compressing applications.

BACKGROUND OF THE INVENTION

It is sometimes desirable to configure a piston-cylinder device, such as an internal combustion engine, so as to be operable at less than full displacement capacity. For example, in automotive applications, it is known to configure eight-cylinder engines so that less than all eight cylinders are operable at any given time. However, conventional multi-cylinder piston-cylinder devices are highly susceptible to vibration when less than all of the cylinders are operating due to unevenly-timed application of power strokes to the crankshaft as it rotates.

SUMMARY OF THE INVENTION

The present invention provides a variable-displacement stacked piston device that may be adapted for use in a combustion engine, a steam or air engine, a compressor, a pump, or the like. The piston-cylinder device defines two or more cylindrical expansion chambers between a "stacked" piston formed of piston members in a coaxial conjoined relationship, and a correspondingly-shaped cylinder, in which substantially any combination of the expansion chambers may be activated or deactivated in order to vary the effective displacement of the piston-cylinder device regardless of the total number of cylinders and pistons in the device. This arrangement may be particularly useful in combustion engines that operate with multiple cylinders, where known methods of shutting off one or more cylinders generally lead to vibration problems that must be addressed in other ways. The piston-cylinder device of the present invention is operable to selectively reduce the effective displacement of each piston-cylinder in mid-operation in order to reduce power output and fuel consumption (or pumping or compressing capacity), without introducing vibration. In addition, a control system is provided for managing the effective displacement of each piston-cylinder according to output required, desirable operating parameters, and other parameters that can effect the operation of the device.

According to one form of the present invention, a variable-displacement piston-cylinder device includes a cylinder defining at least two generally cylindrical chambers of different diameters in substantially coaxial arrangement, and a correspondingly-shaped piston defining at least two conjoined piston members in substantially coaxial arrangement having different diameters corresponding to the diameters of the cylindrical chambers of the cylinder. Each of the at least two cylindrical chambers includes an inlet and an outlet for selectively conducting fluids into and out of a respective one of the chambers. Each of the at least two piston members is reciprocally received in a respective one of the at least two chambers of the cylinder in order to define a displacement volume for each of the cylindrical chambers. A controller is provided for selecting whether the fluid is conducted into the chambers via the inlets. Further, the controller is operable to independently activate and deactivate the at least two chambers by controlling whether the fluid is conducted into either of the at least two chambers.

In one aspect, the cylinder defines at least three generally cylindrical chambers having different diameters. The piston also defines at least three piston members corresponding to the at least three generally cylindrical chambers.

In another aspect, the piston-cylinder device is a combustion engine, a steam engine, an air engine, a fluid pump, a fluid compressor, or a combination thereof.

In yet another aspect, the piston-cylinder device is a combustion engine having an ignition source at each of the chambers. The controller is operable to independently activate and deactivate each of the ignition sources.

In another aspect, the piston-cylinder device is a compression ignition engine.

In still another aspect, each of the inlets includes a valve that is independently operable by the controller to open and close a respective one of the inlets.

In another aspect, at least one of the at least two cylindrical chambers has two inlets, each inlet for conducting a different fluid into the cylindrical chamber. Optionally, at least one of the chambers is operable as either a combustion engine or a fluid pump or compressor.

In a further aspect, the displacement volume of each of the cylindrical chambers is approximately one unit volume larger or smaller than an adjacent one of the cylindrical chambers.

In still another aspect, the displacement volume of each of the cylindrical chambers is approximately twice the volume of the next-smallest chamber.

Optionally, the cylindrical chambers may have different compression ratios from one another, and may be operable on different fuels.

In yet another aspect; the controller receives chamber status data and throttle position data to select which of the at least two chambers to activate or deactivate. Optionally, the controller further receives data pertaining to any of fuel type, engine temperature, exhaust gas properties, ambient temperature, ambient humidity, barometric pressure, emissions, crankshaft angle, engine speed, transmission speed, emission timing, valve timing, vehicle braking status, traction control status, brakes status, suspension status, navigational data, safety systems status, active strategy; transient mode, or operator profile. Data pertaining to various other piston-cylinder parameters, vehicle parameters, and the like may also be collected and used by the controller for controlling piston-cylinder device operations or vehicle operations, for example.

According to another aspect, the piston-cylinder device includes two or more cylinders with corresponding pistons. The pistons each have a connecting rod coupled to a crankshaft so that multiple pistons and cylinders can be joined. The controller is operable to activate and deactivate the same chambers of each cylinder so that each cylinder has substantially the same displacement as the other cylinders at any given moment.

Thus, the present invention provides a variable-displacement stacked piston device that is operable to adjust its effective displacement while it is operating, and/or can adjust its mode of operation to provide different functions (e.g. power output, compression, pumping, etc.) by selecting which inlets and outlets (and/or ignition sources) are activated and operable at any given time. When multiple stacked piston devices are combined into a single operating unit, such as a multi-cylinder engine, the effective displacement may be continuously varied depending on the demands and operating parameters, without imparting vibration to the system due to unbalanced loads. A method of operation includes independently controlling fluid flow into fluid inlets, and/or independently controlling fluid flow out of fluid outlets, and/or independently controlling ignition sources at the cylindrical chambers.

These and other objects, advantages, purposes, and features of the present invention will become apparent upon review of the following specification in conjunction with the drawings.

DESCRIPTION OF THE PREFERRED EMBODIMENTS

Figure 1:
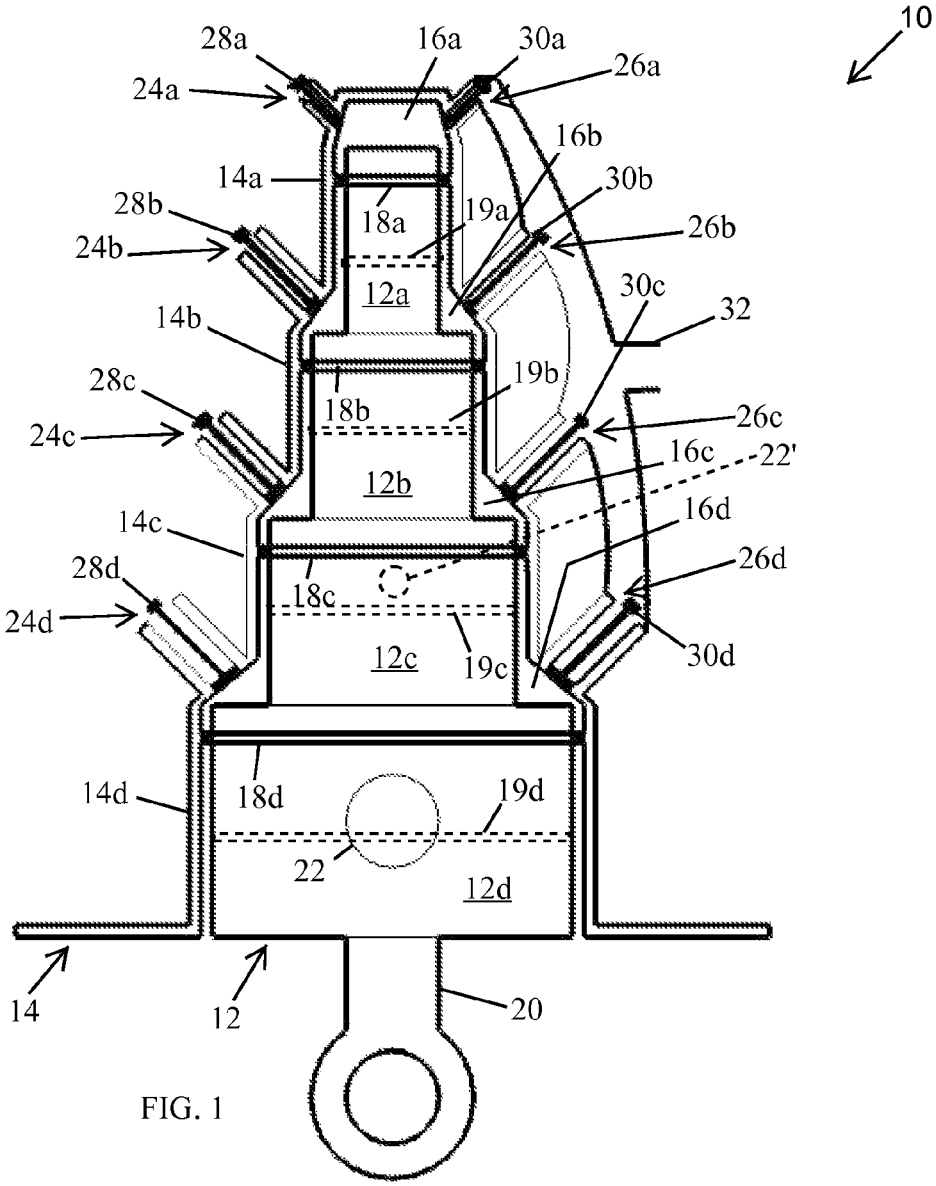
FIG. 1 is a side and partial-cutaway view of a variable-displacement piston-cylinder device in accordance with the present invention.

Referring now to the drawings and the illustrative embodiments depicted therein, a variable-displacement piston-cylinder device 10 provides variable-output capability for a single cylinder, such as for producing power, or for pumping or compressing fluids, or for performing a combination of those tasks, as will be described below. It will be understood that multiple piston-cylinder devices can be combined to provide a multi-cylinder device, such as that depicted in FIG. 2.

In the description that follows, it should be noted that the term "displacement" is used to refer to the volumetric differences of expansion chambers with piston members positioned between bottom dead center (BDC) and top dead center (TDC) in respective cylinder sections, while the term "effective displacement" is used to refer to the volumetric differences of only the activated expansion chambers.

Piston-cylinder device 10 includes a stacked piston 12 that is reciprocally received within a stacked cylinder 14 to define a plurality of expansion chambers 16*a-d* (FIG. 1). Stacked piston 12 includes four distinct piston members 12*a-d* of increasing diameter, while stacked cylinder 14 defines cylindrical chamber sections 14*a-d* of correspondingly increasing diameter. Piston members 12*a-d* are substantially coaxial and conjoined at their ends to one another, and arranged according to size such that the largest-diameter piston member 12*d* is at an end opposite the smallest-diameter piston member 12*a*. Smallest piston member 12*a* is joined to another piston member 12*b* that is larger in diameter than piston member 12*a*, while piston member 12*b* is smaller than the second-largest piston member 12*c* to which second-smallest piston member 12*b* is joined.

Each of stacked cylinder sections 14*a-d* is sized to correspondingly receive a respective one of stacked piston members 12*a-d*, with expansion chambers 16*a-d* defined generally between upper surfaces of stacked piston members 12*a-d* and upper surfaces and inner cylindrical surfaces of corresponding stacked cylinder sections 14*a-d*. In the illustrated embodiments of FIGS. 1 and 2, expansion chamber 16*a* has a solid cylindrical shape, while expansion chambers 16*b-d* are hollow cylindrical chambers with hollow frusto-conical upper portions defined primarily between the top surfaces of stacked piston members 12*b-d* and the top inner surfaces of cylinder sections 14*b-d*. Because the displacement volume of each expansion chamber 16*a-d* is defined between TDC and BDC, the displacement volumes may be calculated as solid or hollow cylinders. For purposes of calculation, it is assumed that each piston member's outer diameter is equal to the inner diameter of the corresponding cylinder section. It will be appreciated that in addition to the generally cylindrical and hollow cylindrical chambers, at least a small amount of expansion chamber volume exists between an outer cylindrical surface of each piston member 12*a-d* and an inner cylindrical surface of each respective cylinder section 14*a-d*; and above and below each piston ring 18*a-d*.

At least one piston ring 18*a-d* is installed at a respective one of stacked piston members 12*a-d* in order to substantially seal against the inner cylindrical surfaces of corresponding stacked cylinder sections 14*a-d*. Of course, multiple piston rings may be installed at each piston member to provide additional sealing (such as at least one ring 18*a-d* near the top of each piston member 12*a-d* and at least one other ring 19*a-d* closer to or near the bottom of each piston member), in order to maintain gas pressure in expansion chambers 16*a-d* and to prevent lubricating oil from entering the chambers.

Stacked piston 12 reciprocates back and forth within stacked cylinder 14 between a TDC position (as in FIG. 1) to define minimum volumes for expansion chambers 16*a-d*, and a BDC position in which the respective volumes of expansion chambers 16*a-d* are at their maxima. A connecting rod 20 is pivotally coupled to the lowermost member 12*d* of stacked piston 12, and may be conventionally coupled thereto, such as by a wrist pin 22, for connection to a rotatable crankshaft (not shown in FIG. 1). Connecting rod 20 may be coupled at other locations along stacked piston 12, such as closer to the middle of piston 12 (as in wrist pin 22' along piston member 12*c*, for example), in order to more evenly distribute loads or stresses along piston 12.

Although shown and described with stacked pistons and cylinders defining three or four expansion chambers, it will be appreciated that the variable-displacement piston-cylinder device of the present invention may be achieved with only two or more expansion chambers per piston-cylinder device, and is not limited to devices having only two or three or four expansion chambers per cylinder, and may include more than four expansion chambers per cylinder; theoretically without limit.

Figure 1A:
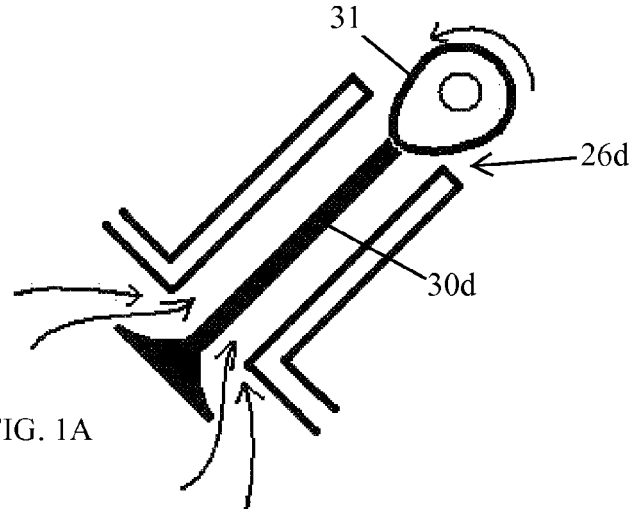
FIG. 1A is a side and partial-cutaway view of an open exhaust valve and valve actuator.

Stacked cylinder 14 includes a plurality of fluid inlets 24*a-d*, with at least one inlet corresponding to each expansion chamber 16*a-d*. Similarly, stacked cylinder 14 includes a plurality of fluid outlets 26*a-d*, with at least one outlet corresponding to each of the expansion chambers 16*a-d*. Each fluid inlet 24*a-d* is selectively opened and closed by a corresponding inlet valve 28*a-d*, and each fluid outlet 26*a-d* is selectively opened and closed by a corresponding outlet valve 30*a-d*. Inlet valves 28*a-d* and outlet valves 30*a-d* are independently actuatable by actuators such as rotating cam 31 (FIG. 1A) or a hydraulic actuator, an electrohydraulic actuator, an electromechanical actuator, or the like so that each of fluid inlets 24*a-d* and fluid outlets 26*a-d* are openable and closable fully independently of the other inlets and outlets. For example, suitable electrohydraulic actuators are marketed as the "Active Valve Train" system by Lotus Engineering of Ann Arbor, Mich. and Eaton Corp. of Cleveland, Ohio; an electrohydraulic valvetrain system ("EHVS") by Robert Bosch GmbH of Gerlingen, Germany; and the VTEC® mechanical-hydraulic valve train by Honda Motor Co. of Tokyo, Japan. In addition, valve timing may be variable according to various parameters such as fuel type, piston speed, throttle position, and the like. Variable valve-timing may be provided by any of the exemplary systems listed above, for example.

In the illustrated embodiment, each expansion chamber 16*b-d* is at least somewhat larger than the expansion chamber immediately above, and each chamber's volume is variable according to the position of piston 12 in cylinder 14. Optionally, and for example, top expansion chamber 16*a* has one unit volume of displacement (e.g. ten cubic inches), second expansion chamber 16*b* has two units volume of displacement (e.g. twenty cubic inches), expansion chamber 16*c* has three units volume displacement (e.g. thirty cubic inches), and fourth expansion chamber 16*d* has four units volume displacement (e.g. forty cubic inches), such that each expansion chamber 16*b-d* is incrementally or sequentially larger than the expansion chamber immediately above by a factor of one "unit volume," where each unit volume is ten cubic inches in the given example. According to another embodiment, each expansion chamber has double the displacement volume of the expansion chamber immediately above, so that each chamber volume is a "binary increment" larger than the one above. It will be appreciated that the expansion chambers may have substantially any displacement volume, and need not be limited to having sequentially larger volumes, proportional volumes, or the like.

In addition, the top surface area of each piston member 12*a-d* may be varied to control the work output or work input that is characteristic of each expansion chamber 16*a-d*. Because the fluid pressure in each expansion chamber 16*a-d* acts upon connecting rod 20 with a magnitude equal to the fluid pressure multiplied by the surface area of each piston member's top surface, the magnitude of the force applied to (or by) connection rod 20 by (or to) piston 12 can be varied by varying the top surface area of each piston member. Those skilled in the art will recognize that the fluid pressure in any given expansion chamber also acts upon the surface area of that piston member's corresponding piston ring (which adds to the force applied to/by connecting rod), and also upon the surface area of the conjoined smaller piston's piston ring, if any, but these other pressures cancel each other out to some degree and are generally considered negligible for purposes of this discussion.

The relationships between radius (or diameter) and volume of each expansion chamber, and the potential benefits derived therefrom, may be more fully understood by considering the geometrical implications of selecting specific dimensions of each chamber. For example, it may be desirable to provide a sequential progression of expansion chamber displacement volumes from top expansion chamber 16*a* to bottom expansion chamber 16*d*; where the displacement volume of top chamber 16*a* is one unit volume, the displacement volume of top-middle chamber 16*b* is two units volume, the displacement volume of bottom-middle chamber 16*c* is three units volume, and the displacement volume of bottom chamber 16*d* is four units volume, etc. To achieve these ratios for any given length stroke of piston 12, the radius of top chamber 16*a* will be one unit length, the radius of top-middle chamber 16*b* will be about 1.73 (the square root of three) units length, the radius of the bottom-middle chamber 16*c* will be about 2.45 (the square root of six) units length, and the radius of the bottom chamber 16*d* will be about 3.16 (the square root of ten) units length.

To derive the proper radius for each of chambers 16*a-d* to achieve a sequential progression of displacement volumes, it should be understood that the volume of each solid or hollow-cylindrical expansion chamber is calculated by multiplying the surface area of the corresponding piston member 12*a-d* by the piston stroke 'h'. Thus, the volume of a solid cylinder is equal to Pi multiplied by radius squared, multiplied by height (i.e. piston stroke), or $V=\pi r^2 h$, while the volume of a hollow cylinder is equal to Pi multiplied by the resultant of the outer radius squared minus the inner radius squared, multiplied by height, or $V=\pi(r_o^2-r_i^2)h$. Because Pi and h are constant, volume (V) is varied only by changing radii. Thus, to achieve a displacement volume of top-middle expansion chamber 16*b* that is twice the volume of top expansion chamber 16*a*, where the inner radius $r_i$ of top-middle expansion chamber 16*b* is, by definition, equal to the radius r of top expansion chamber 16*a* (which is taken to be one unit length), $V_{top}=\pi r^2 h$, which equals $\pi h$ with r equal to unit length. Since $V_{top\text{-}middle}=\pi(r_o^2-r_i^2)h$, which equals $\pi(r_o^2-1)h$ for $r_i=1$, and is further equal to twice the displacement volume of top expansion chamber 16*a* (i.e. $V_{top}$), then it follows that $\pi h(r_o^2-1)=2\pi h$. Accordingly, $r_o^2-1=2$ and $r_o=\sqrt{3}$ or approximately 1.73 when the radius r of top expansion chamber 16*a* is equal to 1. By using similar formulae, the radii of every other expansion chamber may be derived to achieve the sequential progression of displacement volumes described above. Thus, for a given radius 'r' of top expansion chamber 16*a*, the outer radius of top-middle expansion chamber 16*b* will be $r\sqrt{3}$, the outer radius of bottom-middle chamber 16*c* will be $r\sqrt{6}$, and the outer radius of bottom chamber 16*d* will be $r\sqrt{10}$ to obtain a sequential progression of expansion chamber displacement volumes.

It may further be desirable to provide a binary progression of expansion chamber displacement volumes from top expansion chamber 16*a* to bottom expansion chamber 16*d*, where the displacement volume of top chamber 16*a* is one unit volume, the displacement volume of top-middle chamber 16*b* is two units volume, the displacement volume of bottom-middle chamber 16*c* is four units volume, and the displacement volume of bottom chamber 16*d* is eight units volume. The corresponding ratios of radii for expansion chambers 16*a-d* to obtain a binary progression of expansion chamber displacement volumes may be derived in a similar manner as described above with reference to the sequential progression, by taking into account that each successively larger expansion chamber has twice the displacement volume of the one immediately above. Performing the calculations of each expansion chamber's radius, taking the radius of top expansion chamber 16*a* to be one unit length, results in top-middle expansion chamber 16*b* being about 1.73 (the square root of three) units length, the radius of the bottom-middle chamber 16*c* being about 2.65 (the square root of seven) units length, and the radius of the bottom chamber 16*d* being about 3.87 (the square root of fifteen) units length. In other words, for a given radius 'r' of top expansion chamber 16*a*, the outer radius of top-middle expansion chamber 16*b* will be r√3, the outer radius of bottom-middle chamber 16*c* will be r√7, and the outer radius of bottom chamber 16*d* will be r√15 to obtain a binary progression of expansion chamber displacement volumes.

Because expansion chamber volumes are calculated by multiplying the surface area of each piston member 12*a-d* by piston stroke 'h' (area being measured as $\pi r^2$ for piston member 12*a* and $\pi(r_o^2-r_i^2)$ for piston members 12*b-d*), with stroke 'h' being a constant, it will be readily understood by those skilled in the art that the areas of the top surfaces of the piston members 12*a-d* will also follow either a sequential or binary progression if the radii are selected to achieve a sequential or binary progression of expansion chamber displacement volumes.

For example, given the sequentially larger expansion chambers 16*a-d* described above, if top piston member 12*a* has a top surface area of one unit area, top-middle piston member 12*b* has a top surface area of two units area (i.e. two times the area of piston member 12*a*), bottom-middle piston member 12*c* has a top surface area of three units area, and bottom piston member 12*d* has a top surface area of four units area, and if each expansion chamber 16*a-d* has a compression ratio equal to every other expansion chamber, then the forces applied by each piston member 12*a-d* is similarly proportional. That is, given the above assumptions and an equal fluid pressure in each of expansion chambers 16*a-d*, piston member 16*b* exerts twice the force on connecting rod as piston member 16*a*, piston member 16*c* exerts three times the force on connecting rod as piston member 16*a*, and piston member 16*b* exerts four times the force on connecting rod as piston member 16*a*. This characteristic or ability to increase or decrease the force exerted upon connecting rod 20 by even increments, by activating and deactivating certain expansion chambers, enhances the smoothness with which the effective displacement of each cylinder is changed.

A plenum or manifold 32 is installed at fluid outlets 26*a-d* to collect fluids exhausted through the fluid outlets, while a similar plenum or manifold (not shown in FIG. 1) may be provided at fluid inlets 24*a-d* in order to direct a desired fluid into expansion chambers 16*a-d*. In embodiments having at least one expansion chamber producing output power, connecting rod 20 is reciprocally driven by piston 12 in order to turn a crankshaft. Alternatively, where none of the expansion chambers produce power and are instead used for pumping, compressing, or the like, a crankshaft coupled to connecting rod 20 is driven by an outside power source in order to cause piston 12 to reciprocate within cylinder 14.

Figure 2:
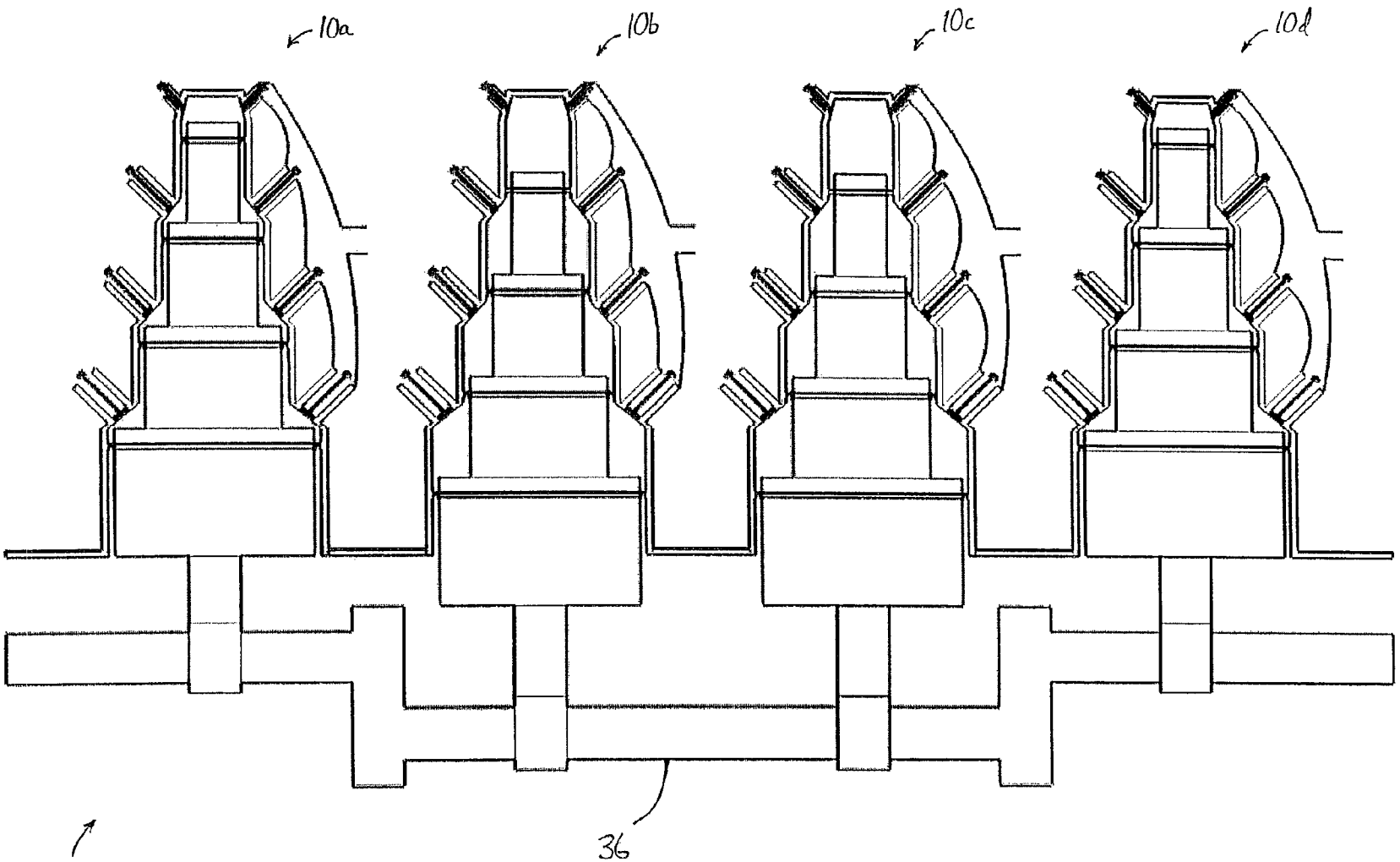
FIG. 2 is a side and partial-cutaway view of a multi-cylinder stacked piston device.

For example, in the illustrated embodiment of FIG. 2, a multi-cylinder device 34 includes four separate variable-displacement piston-cylinder devices 10*a-d* linked together via a crankshaft 36 to provide a four cylinder inline-configuration engine or pump or compressor (or combination thereof). As shown in FIG. 2, piston-cylinder devices 10*a*, 10*d* are at their top dead center (TDC) configurations, while piston-cylinder devices 10*b*, 10*c* are at their respective bottom dead center (BDC) configurations. When multi-cylinder device 34 is arranged in a conventional four-stroke configuration, piston-cylinder device 10*a* is at the end of its compression or exhaust stroke, while piston-cylinder device 10*d* is at the end of its exhaust or compression stroke (whichever is the opposite of device 10*a*), and piston-cylinder device 10*b* is at the end of its expansion or intake stroke while piston-cylinder device 10*c* is at the end of its intake or expansion stroke (whichever is the opposite of device 10*b*). Thus, when multi-cylinder device 34 is in normal four-stroke operation, variable-displacement piston-cylinder devices 10*a-d* may be timed or coordinated to operate in a substantially conventional manner relative to one another, with each cylinder firing once for every two revolutions of crankshaft 36. However, as will be described in greater detail, each piston-cylinder device 10*a-d* may be configured or controlled to have more than one power stroke for every two revolutions of crankshaft 36, or may be configured or controlled to provide a combination of power-production, fluid compression, and/or fluid pumping.

Figure 3:
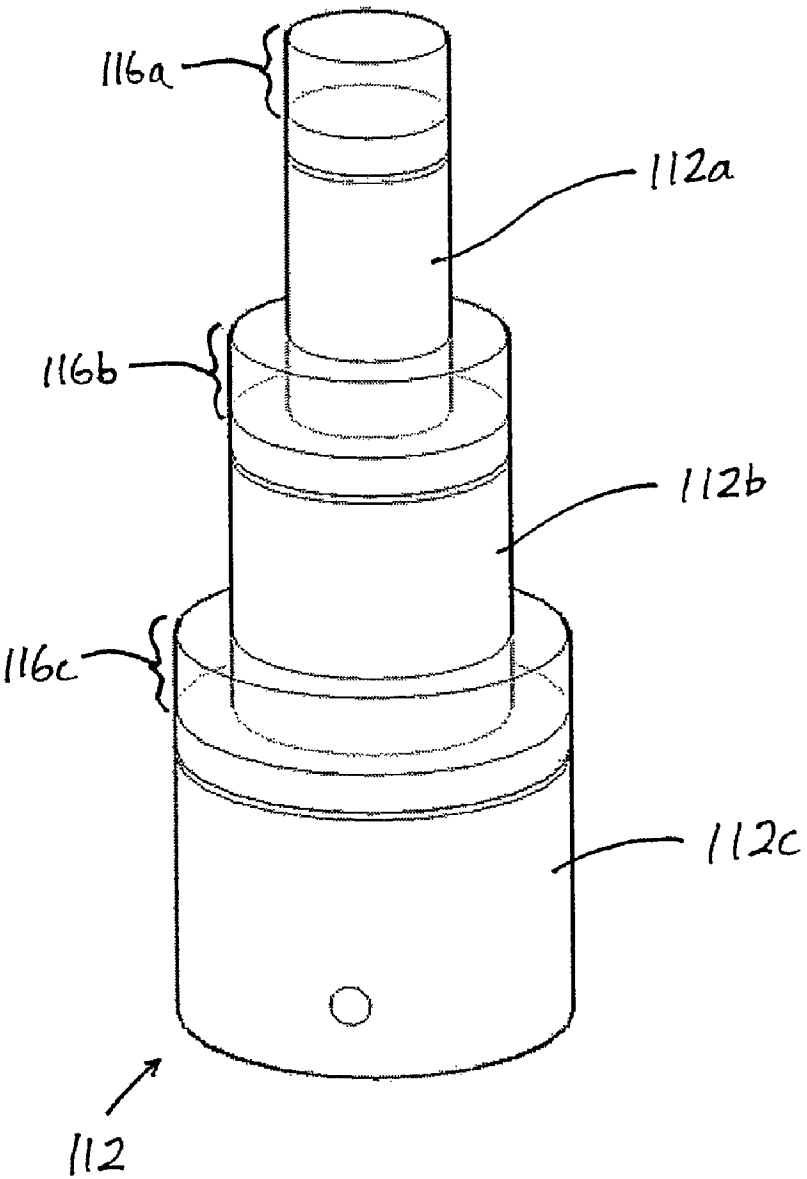
FIG. 3 is a perspective view diagram of a stacked piston and expansion chambers.
Figure 4:
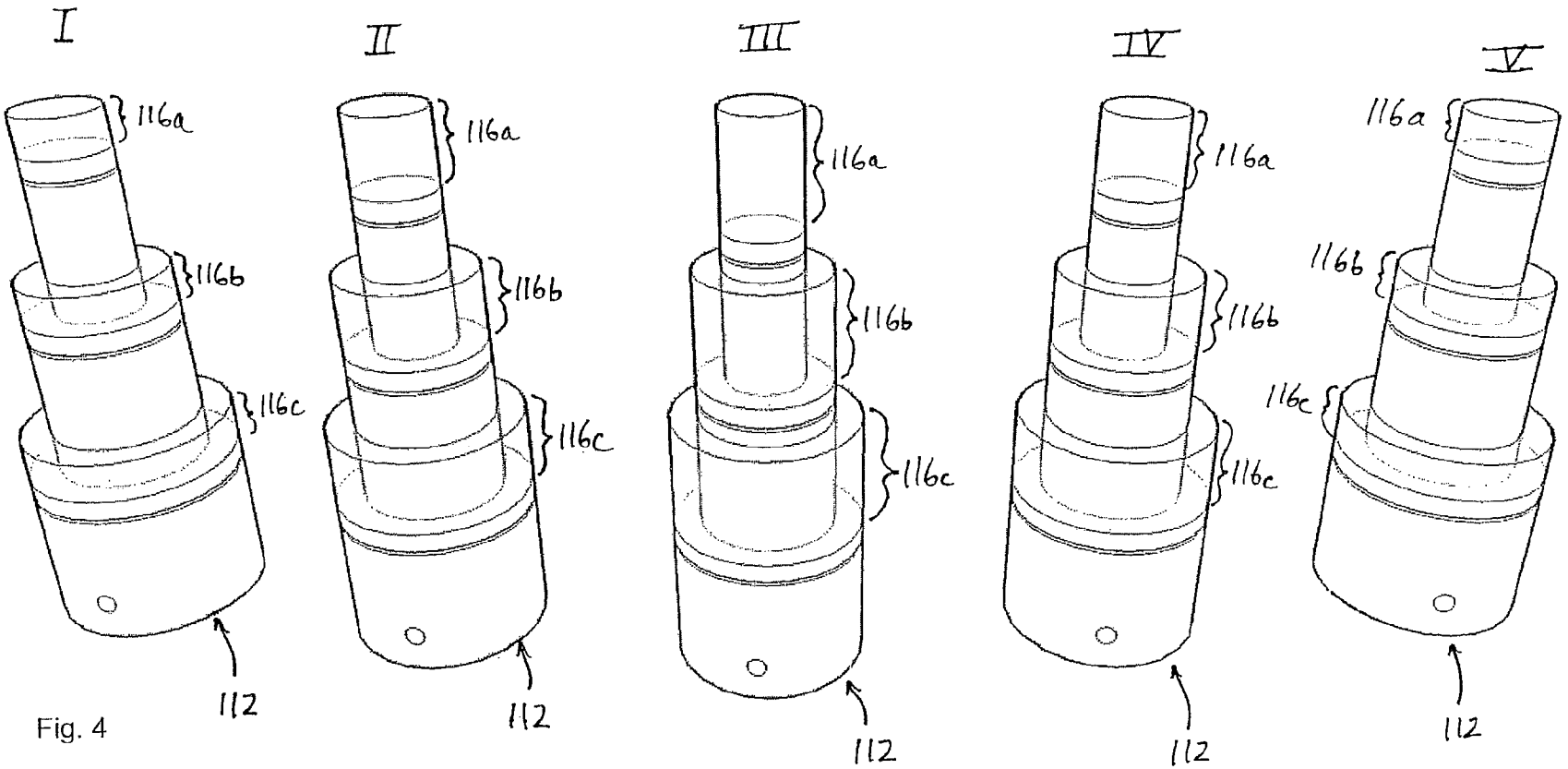
FIG. 4 is a perspective view diagram of a stacked piston moving through one expansion and compression cycle.
Figure 5:
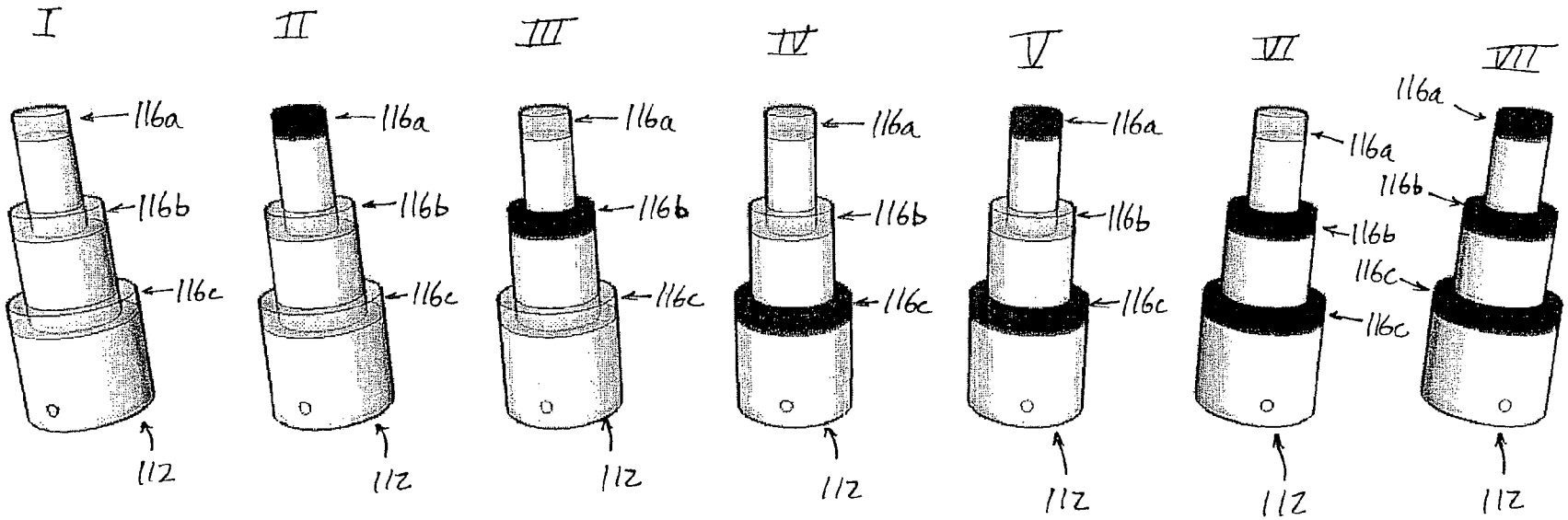
FIG. 5 is a perspective view of the various effective displacements that can be achieved in a three-chamber stacked piston device.

Referring now to FIGS. 3-5, a three-member stacked piston 112 is shown along with the displacement volumes represented by expansion chambers 116*a-c* defined between piston members 112*a-c* and portions of a corresponding stacked cylinder, which is omitted in FIGS. 3-5 for clarity. Top expansion chamber 116*a* has a solid cylindrical shape, while expansion chambers 116*b*, 116*c* are hollow-cylinder or donut-shaped volumes above the top surfaces of stacked piston sections 112*b*, 112*c*. Stacked piston 112 reciprocally translates between TDC and BDC, as shown in FIG. 4, which shows five positions (I-V) of piston 112 in one reciprocating cycle. In position I, piston 112 is at TDC (wherein displacement volumes, represented by expansion chambers 116*a-c*, are at their respective minima), while in position II, piston 112 is halfway between TDC and BDC. In position III, piston 112 is at BDC, at which displacement volumes 116*a-c* are at their respective maxima. In position IV, stacked piston 112 is again halfway between BDC and TDC, while in position V, piston 112 is once again at TDC and the displacement volumes 116*a-c* are at their respective minima.

It will be understood that each expansion chamber may have a different compression ratio from the other chambers, and that each chamber may be configured for operation as a combustion engine on different fuels (such as relatively low compression for gasoline operation and relatively high compression for diesel operation). Such configurations may be useful, for example, to ease starting of an engine that operates primarily on diesel fuel, with one of the smaller chambers adapted for starting the engine on gasoline, which is easier to ignite at cold temperatures, before diesel fuel is admitted to the other chambers. The operation of engines in accordance with the present invention, with two or more different inlet fluids, is described in greater detail below with respect to FIG. 8.

In operation, each expansion chamber 116*a-c* may be independently "activated" and "deactivated" in order to control the output power, pumping capacity, or compression volume or pressure, such as depicted in FIG. 5, in which expansion chambers 116*a-c* are depicted as either lightly-shaded to signify deactivated chambers (e.g. state I of FIG. 5) or darkly-shaded to signify activated chambers (e.g. state VII of FIG. 5). In the illustrative embodiment of FIG. 5, three-chamber stacked piston 112 includes three separate and independently-activatable expansion chambers 116*a-c* according to seven possible states of operation (states I-VII).

In state I of FIG. 5, each of expansion chambers 116*a-c* is deactivated such that no work is provided or performed by stacked piston 112. In state II, top expansion chamber 116*a* is active while the middle and bottom expansion chambers 116*b-c* are inactive, in order to provide a minimum level of work by piston 112. In state III, middle expansion chamber 116*b* is active while top expansion chamber 116*a* and bottom expansion chamber 116*c* are inactive, in order to provide a sequentially greater amount of work than in state II, assuming expansion chamber 116*b* is greater than expansion chamber 116*a*. In state IV, bottom expansion chamber 116*c* is active while top and middle expansion chambers 116*a-b* are inactive, in order to provide a sequentially yet greater amount of work by stacked piston 112, assuming that expansion chamber 116*c* is somewhat larger than expansion chamber 116*b*. In state V, top expansion chamber 116*a* and bottom expansion chamber 116*b* are active while middle expansion chamber 116*b* is inactive, in order to provide a sequentially greater amount of work by piston 112. In state VI, middle expansion chamber 116*b* and bottom expansion chamber 116*c* are active, while top expansion chamber 116*a* is inactive, to provide sequentially yet greater amount of work by piston 112. In state VII, each of expansion chambers 116*a-c* is active, in order to provide a maximum amount of work by piston 112.

Although not shown in FIG. 5, an eighth state would also be available in the of activation of top expansion chamber 116*a* and middle expansion chamber 116*b*, combined with the inactivation of a bottom expansion chamber 116*c*. Where the displacement volume of expansion chamber 116*b* is one unit volume larger than top expansion chamber 116*a*, and bottom expansion chamber 116*c* is one unit volume larger than middle expansion chamber 116*b*, activating only top and middle expansion chambers 116*a-b* would provide the same effective displacement volume as state IV of FIG. 5. This "equivalence" may be useful, for example, such as for controlling wear or cooling, or other aspects, as will be discussed below.

It can now be appreciated that if top expansion chamber 116*a* is "one unit" of displacement volume, while middle expansion chamber 116*b* is "two units" of displacement volume, and bottom expansion chamber 116*c* is "three units" of displacement volume (such as, for example, ten cubic inches, twenty cubic inches, and thirty cubic inches, respectively), then each of states I-VII of FIG. 5 represents what is substantially a sequentially greater amount of work capacity by piston 112. Where the displacement volumes of expansion chambers 116*a-c* are ten cubic inches, twenty cubic inches and thirty cubic inches, respectively, then state I represents a zero displacement state (i.e. no work is being done), ten cubic inches of displacement are at work in state II, twenty cubic inches of displacement are at work in state III, and thirty cubic inches of displacement are at work in state IV. States V-VII use combinations of expansion chambers 116*a-c* to achieve even greater total effective displacement volumes, i.e. state V represents forty cubic inches of displacement, state VI represents fifty cubic inches of displacement, and state VII represents sixty cubic inches of displacement. The three chamber stacked piston 112 in the illustrative example is thus capable of operating with as little as zero displacement and at any of six different non-zero displacements that are sequentially variable by increments of ten cubic inches or integer multiples thereof.

When a given expansion chamber is deactivated, all valves are generally closed and the chamber is doing no useful work. The piston portion corresponding to the particular expansion chamber is compressing and decompressing trapped chamber air (or other fluid), which offers little drag or parasitic losses to the piston due to the "spring" action of the compressed air in the chamber. With intake and exhaust valves held open, the chamber pumps uncompressed air into and out of the chamber via the fluid inlets and fluid outlets, such as for cooling and/or emission purposes. Although this operational configuration generally induces more drag on the piston (by pumping a gas in and out of the expansion chamber(s)) than when all valves are held closed, this configuration still offers generally little drag and may be used such as for reducing the power needed to drive the crankshaft and piston during cold starting operations.

In a "compressor" setting, intake valves open and close to admit air or other compressible fluid into the expansion chamber during a piston down-stroke, and compress the fluid during a piston up-stroke. During the compression stroke, a compressor exhaust valve opens to admit the compressed air or compressible fluid into a holding tank for later use. Alternatively, the compressed air or fluid can be used to "supercharge" another expansion chamber of the device via a selectively openable conduit connecting one expansion chamber to another.

Thus, it may be observed that by combining two or more cylinders with the stacked pistons 112, one may obtain an engine or pump or compressor having two or more cylinders, in which the effective capacity of the engine (or pump or compressor) may be varied by controlling the effective displacement of each cylinder in the same manner as the other cylinders, so as not to cause imbalance by having cylinders of different output capacity linked together. That is, when multiple piston-cylinder devices of the present invention are combined into a single engine or pump or compressor, each individual piston-cylinder device may be controlled in the same manner as all of the other piston-cylinder devices so that each device is operating at substantially the same output capacity so as not to impart vibration or imbalance to the combined system.

Optionally, it is envisioned that the variable-displacement piston-cylinder device of the present invention may be combined with known methods of varying the effective displacement of piston-cylinder devices, such as changing the lengths of connecting rods or changing the positions or volumes of cylinder heads, in order to achieve a "hybrid" variable-displacement piston-cylinder device, without departing from the spirit and scope of the present invention. It is envisioned that substantially all improvements and developments currently underway in developments for engines, pumps, and compressors using pistons and cylinders are compatible with the variable-displacement piston-cylinder device of the present invention.

Figure 6:
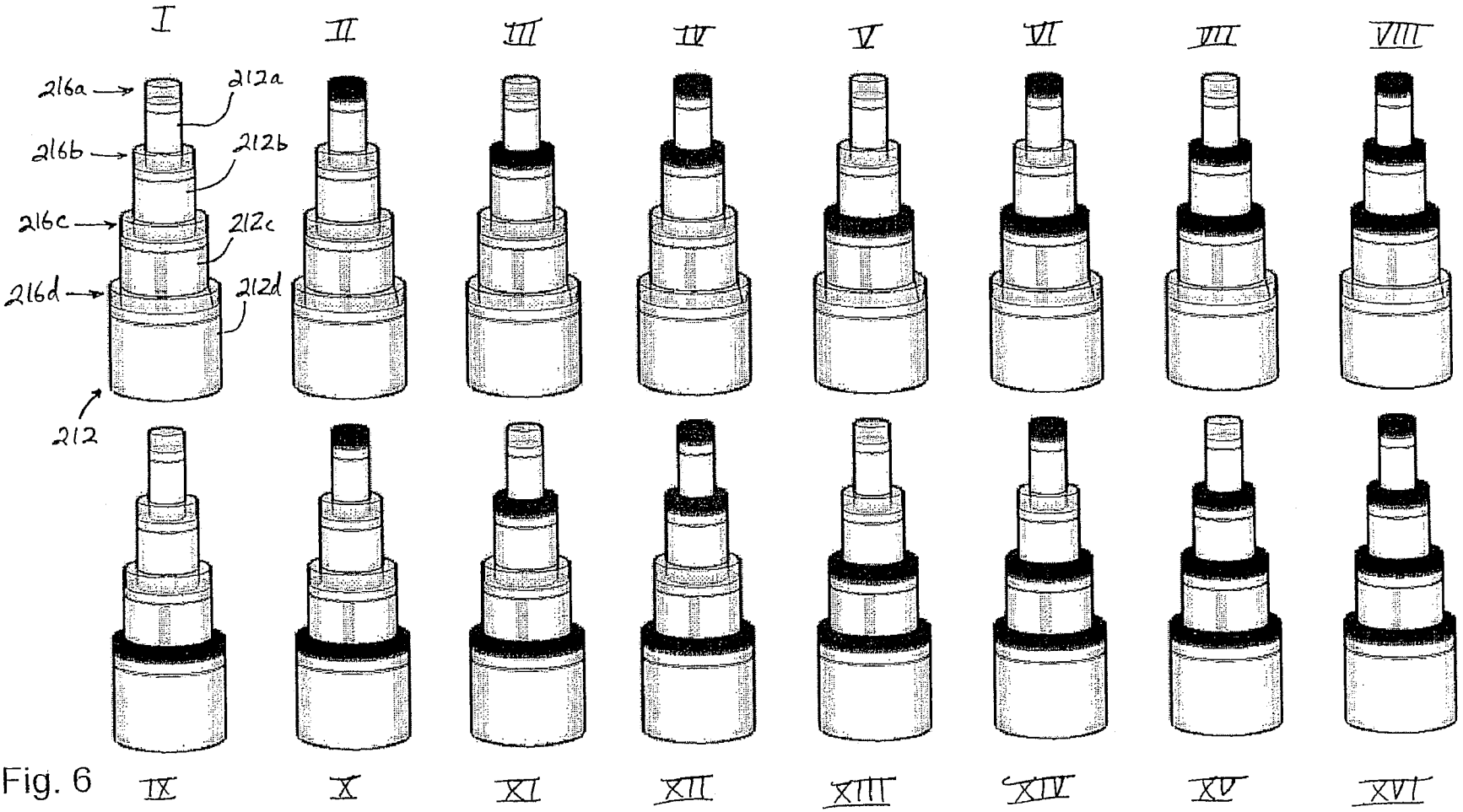
FIG. 6 is a perspective view of the various effective displacements that can be achieved in a four-chamber stacked piston device.

Referring now to FIG. 6, a four-chamber stacked piston 212, similar to stacked piston 12 of FIG. 1 but including four coaxial, joined piston cylinders 212*a-d* having different diameters with the smallest piston cylinder 212*a* being at the top and progressing with successively larger diameter cylinders to the largest piston cylinder 212*d* at the bottom. Piston 212 defines four expansion chambers 216*a-d* (labeled as such only on state I of FIG. 6), where each of expansion chambers 216*b-d* is a "binary increment" larger than the expansion chamber immediately above. In other words, where the top expansion chamber 216*a* is taken to be one unit volume, the top-center expansion chamber 216*b* would be two units volume, the bottom-center expansion chamber 216*c* would be four units volume, and the bottom expansion chamber 216*d* would be eight units volume. In FIG. 6, sixteen states of operation are depicted in a similar manner to the seven states of FIG. 5, using dark shading and light shading to indicate active and inactive expansion chambers, respectively. In the "binary displacement" embodiment of FIG. 6, however, each of the sixteen operating states is unique, such that there is no available state that provides the same effective displacement beyond those which are illustrated in FIG. 6.

Figure 7:
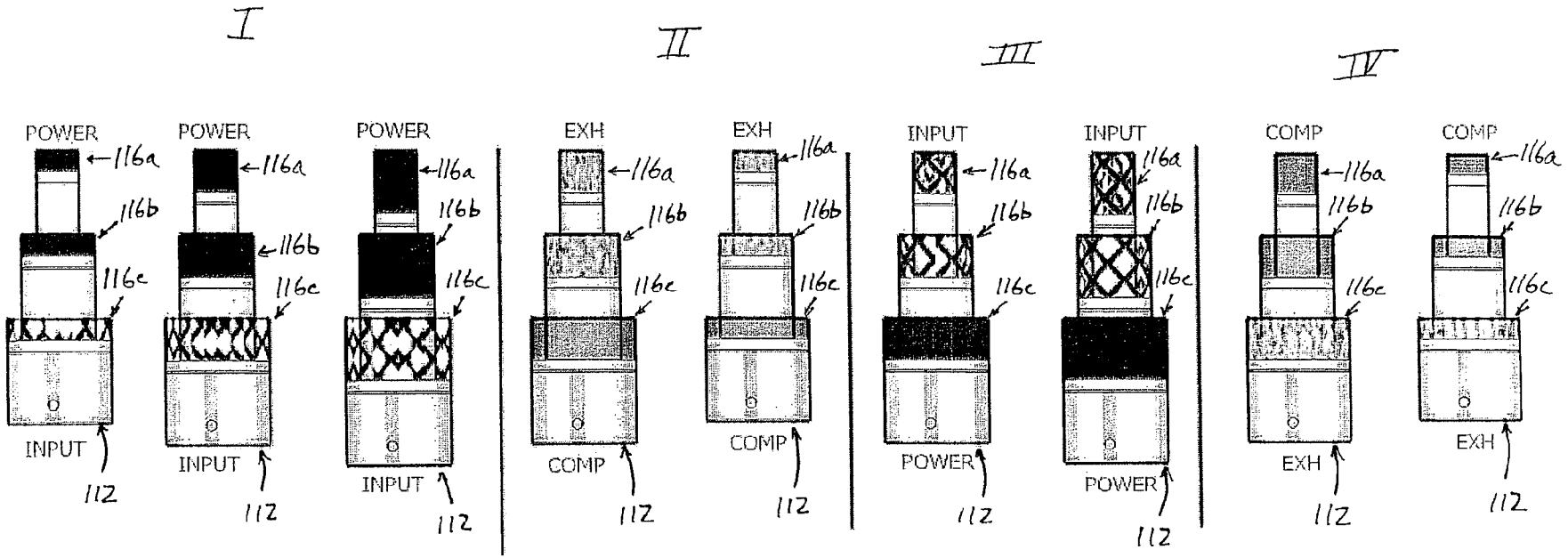
FIG. 7 is a side diagram view of a three-chamber piston-cylinder device for producing a power stroke corresponding to each revolution of a four-stroke cycle.

Accordingly, state I represents zero displacement, state II represents one unit volume of displacement, state III represents two units volume of displacement, state IV represents three units volume of displacement, state V represents four units volume of displacement, state VI represents five units volume of displacement, state VII represents six units volume of displacement, state VIII represents seven units volume of displacement, state IX represents eight units volume of displacement, state X represents nine units volume of displacement, state XI represents ten units volume of displacement, state XII represents eleven units volume of displacement, state XIII represents twelve units volume of displacement, state XIV represents thirteen units volume of displacement, state XV represents fourteen units volume of displacement, and state VXI represents fifteen units volume of displacement. Accordingly, it will be readily apparent to those skilled in the art that the use of expansion chambers having binary incremental displacement volumes maximizes the number of effective displacement volumes possible with a given number of piston members in a cylinder device, while avoiding the possibility of redundant states that provide equal effective displacements using different combinations of expansion chambers. This effect increases with the number of expansion chambers associated with each cylinder. For example, in a three-chamber cylinder, a binary configuration yields seven volumetric states as opposed to six for the sequential configuration, while in a four-chamber cylinder, a binary configuration yields fifteen volumetric states as opposed to ten for the sequential configuration As described briefly above, the independent control of each fluid inlet and fluid outlet for each expansion chamber permits the optional use of a piston-cylinder device for two or more different functions, or to provide more than one power stroke for every two revolutions during four-stroke cycle operation (FIG. 7). As explained below, by offsetting the operation of the fluid inlets and outlets of the top and middle chambers 116*a*, 116*b* in FIG. 7 by 180 degrees (of rotation of a corresponding crankshaft) from the operation of the inlet and outlet of the bottom chamber 116*c*, it will be observed that every down-stroke of piston 112 is a power stroke driven by the same volume of displacement upon each revolution or reciprocation of piston 112.

In the illustrated embodiment of FIG. 7, stacked piston 112 and its three members 112*a-c* are acted upon by combustion gases or compressed gases in expansion chambers 116*a-c*. The effective displacement volume of the combination of top and middle expansion chambers 116*a-b* is equivalent to the displacement volume of bottom expansion chamber 116*c*. In FIG. 7, dark shading is used to indicate expansion chambers undergoing a power stroke, cross hatching is used to indicate input or intake strokes, light shading is used to indicate compression strokes, and mottled or speckled shading is used to indicate exhaust strokes, for a four-stroke internal combustion engine.

In state I of FIG. 7, top and middle expansion chambers 116*a-b* are undergoing a power stroke while bottom expansion chamber 116*c* is undergoing an intake stroke. In state II, expansion chambers 116*a-b* are undergoing an exhaust stroke, while bottom expansion chamber 116*b* is undergoing a compression stroke. In state III, top and middle expansion chambers 116*a-b* are undergoing an intake stroke, while bottom expansion chamber 116*c* is undergoing a power stroke. In state IV, top and middle expansion chambers 116*a-b* are undergoing a compression stroke, while bottom expansion chamber 116*c* is undergoing an exhaust stroke. Accordingly, top and middle expansion chambers 116*a-b* are undergoing a conventional four-stroke cycle that is 180 degrees out-of-phase with the conventional four-stroke cycle of bottom expansion chamber 116*c*. In this manner, every revolution of a crankshaft that is associated with stacked piston 112 receives a power stroke that results from the combustion of gases having the same quantity as the gases driving the previous power stroke, which permits smooth operation and increased power from the device for a given effective displacement.

It will be appreciated that the expansion chambers 116*a-c* may be operated in-phase (i.e. all chambers firing upon the same stroke) or 180 degrees out-of-phase, and switched between these modes at will. For example, when additional power is desired, all three expansion chambers 116*a-c* may be operated in-phase to achieve an effective six units volume of displacement firing in synchronization, while it may be desirable to operate the piston-cylinder device at 180 degrees out of phase (firing three units volume of displacement in alternating expansion chambers at each downstroke, for example) for reduced power operation.

Optionally, the various expansion chambers of the variable-displacement piston-cylinder device may be simultaneously used for different purposes. For example, large volumes of low-pressure fluid may be pumped by a piston-cylinder device of the present invention, by using one or more smaller expansion chambers as an engine (e.g. internal combustion engine) while a lower and larger chamber or chambers are used for pumping or compressing fluid. Similarly, relatively small amounts of high-pressure fluid may be pumped or compressed by using the larger chambers as an engine, while using the upper or smaller chambers as compressors or pumps.

Figure 8:
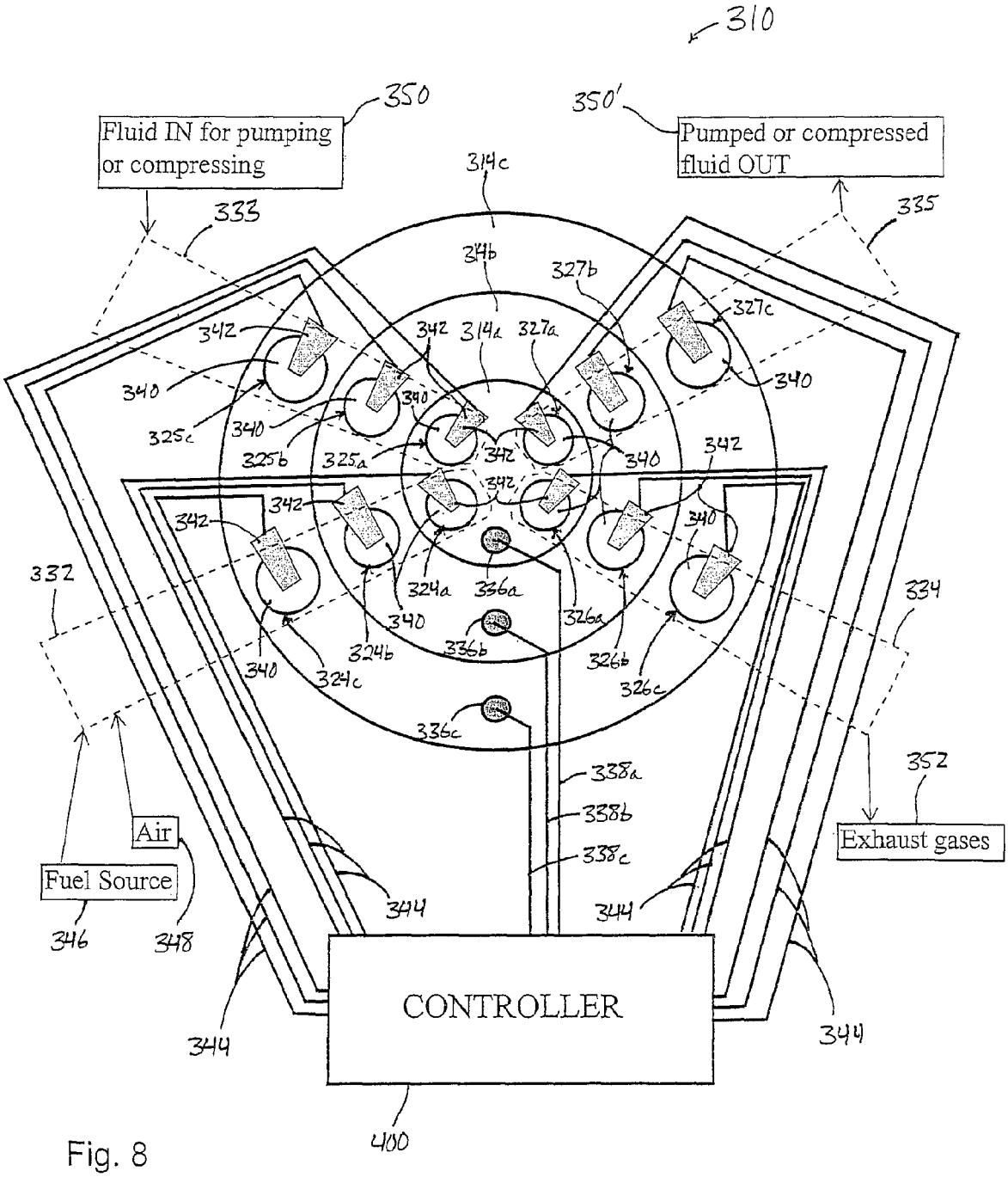
FIG. 8 is a plan view of a three-chamber piston-cylinder device having two separate fluid inlets and two separate fluid outlets at each cylinder portion.

Optionally, and with reference to FIG. 8, the operation of a piston-cylinder device 310 of the present invention may be controlled between power-producing and fluid-pumping or compressing configurations. Device 310 includes three cylinder portions 314*a-c*, each portion having a first fluid inlet 324*a-c* and a second fluid inlet 325*a-c*, and each portion 314*a-c* further having a first fluid outlet 326*a-c* and a second fluid outlet 327*a-c*. First fluid inlets 324*a-c* are associated with a first fluid intake manifold 332 and second fluid inlets 325*a-c* are associated with a second fluid intake manifold 333, while first fluid outlets 326*a-c* are associated with a first fluid exhaust manifold 334 and second fluid outlets 327*a-c* are associated with a second fluid exhaust manifold 335. Optionally, such as when piston-cylinder device 310 functions at least partially as an internal-combustion engine, each cylinder portion 314*a-c* includes an ignition source 336*a-c* such as a spark plug, a glow plug, or the like, which is selectively energized by a respective ignition wire 338*a-c*.

Each fluid inlet and each fluid outlet is sealable by an actuatable valve 340, where each valve 340 is selectively operable and closable by a respective actuator 342, which may be a cam (like cam 31 of FIG. 1A), a hydraulic actuator, an electrohydraulic actuator, an electromechanical actuator, or the like. Each actuator 342 is independently controllable by a controller 400 and is linked thereto by a transmission device 344, which may be an electronic signal wire, a mechanical connection, or the like.

In the illustrated embodiment of FIG. 8, first fluid intake manifold 332 receives fuel from a fuel source 346 (such as a carburetor or fuel injector downstream of a throttle body, or the like) and air or oxygen from another source 348, and directs it into one or more of first fluid inlets 324*a-c* when a respective valve 340 is opened by a respective actuator 342. Optionally, piston-cylinder device 310 may be equipped for direct-injection of fuel into cylinder portions 314*a-c* to avoid injecting or conducting fuel through one of intake manifolds 332, 333. Second fluid intake manifold 333 receives a fluid 350, such as a compressible gas for compressing or pumping, or a substantially incompressible liquid for pumping, and directs it into one or more of second fluid inlets 325*a-c* when a respective valve 340 is opened by a respective actuator 342. First fluid exhaust manifold 334 receives combustion gases 352 from the burning of fuel and directs it away from one or more of first fluid outlets 326*a-c* when a respective valve 340 is opened by a respective actuator 342. Second fluid exhaust manifold 335 receives higher-energy fluid 350' (e.g. higher pressure, higher velocity, higher heat, higher potential energy, etc.) that was previously received as lower-energy fluid 350 by second fluid intake manifold 333, and directs the fluid 350' away from one or more of second fluid outlets 327*a-c* and, optionally, into a pressure tank or holding tank or the like.

In operation, piston-cylinder device 310 may operate solely as a combustion engine, via coordinated operation of any combination of first inlet valves 324*a-c* and respective first outlet valves 326*a-c*, with ignition provided by ignition sources 336*a-c*. In order to increase operating efficiency and power output, second inlet valves 325*a-c* and second outlet valves 327*a-c* may be used to input fuel/air and to exhaust combustion gases, respectively.

Piston-cylinder device 310 may also be operated as a combination engine/pump or engine/compressor, such as by using cylinder portion 314*c* as an internal-combustion engine as described above, while operating first inlet valve 324*c*, second outlet valve 326*c*, and ignition source 336*c*, and by using cylinder portions 314*a-b* for pumping fluid 350 via second inlet valves 325*a-b* and second outlet valves 327*a-b*. When used as an engine/pump or engine/compressor combination, controller 400 controls each valve 340 and ignition source 336*a-c* independently (leaving closed the valves 340 associated with each of first fluid inlets 324*a-b*, first fluid outlets 326*a-b*, second fluid inlet 325*c*, and second fluid outlet 327*c*, and disabling ignition sources 336*a-b* during such operation) in order to direct fuel and air through first inlet manifold 332 and into an expansion chamber contained in cylinder portion 314*c*, to direct combustion gases out of the expansion chamber contained in cylinder portion 314*c* out through first exhaust manifold 334, and to direct a fluid for pumping or compression into and out of expansion chambers defined by cylinder portions 314*a-b*, via second inlet manifold 333 and second outlet manifold 335. It will be appreciated that each expansion chamber associated with each of cylinder portions 314*a-c* may be used as either an engine or as a pump/compressor, that the respective expansion chambers may be adapted to perform different functions by independently controlling actuators 342 and ignition sources 336*a-c*, and that the function of each expansion chamber can be changed without halting operation of piston-cylinder device 310. For example, first fluid inlets 324*a-c* and first fluid outlets 326*a-c* may be adapted from combustion/exhaust operation to pumping/compression operation simply by turning off fuel source 346 and disabling ignition sources 336*a-c*. It will further be appreciated that substantially any number of fluid inlets, fluid outlets, and manifolds may be used to accommodate various engine or pumping/compressing needs, and that certain expansion chambers may have dedicated purposes (e.g. pumping only), without departing from the spirit and scope of the present invention.

Piston-cylinder device 310 may also operate solely as a fluid pump or compressor, via coordinated operation of any combination of second inlet valves 325*a-c* and respective first outlet valves 327*a-c*, with ignition sources 336*a-c* disabled. Optionally, such as in order to increase operating efficiency while pumping or compressing fluid 350, first inlet valves 324*a-c* and second outlet valves 326*a-c* may be used to input fluid 350 and to exhaust higher pressure fluid 350', respectively, in the same manner as second inlet valves 325*a-c* and second outlet valves 327*a-c*. During operation of piston-cylinder device 310 solely as a pump or compressor, a piston inside cylinder portions 314*a-c* is reciprocally driven by an external source, such as by a connecting rod connected to a crankshaft driven or rotated by an external power source or engine, and it may generally be desirable for controller 400 to disable ignition sources 336*a-c* such as by providing two or more isolated fluid inlets (such as inlets 324*a-c*) and two or more isolated fluid outlets (such as outlets 326*a-c*) at each cylinder portion 314*a-c* for each expansion chamber, as described above with reference to FIG. 8.

Thus, by supplying a fuel/air mixture to one fluid inlet, with a corresponding combustion gas exhaust fluid outlet and manifold, along with a pumping-fluid inlet and outlet for each expansion chamber, the valves controlling each fluid inlet and outlet may be independently controlled so that any given expansion chamber can be automatically configured to operate as either an engine for driving the piston (by selectively opening and closing only the fluid inlet and outlet associated with the fuel/air mixture) or for pumping or compression operation by closing the fluid inlet and outlet associated with the fuel/air mixture and selectively opening and closing the fluid inlet and outlet associated with the pumping or compressing action.

In operation as an engine, such as an internal combustion engine (gasoline, diesel, propane, compressed natural gas, liquid petroleum gas, ethanol, biofuels, etc.; two-stroke cycle, four-stroke cycle, Otto cycle, Atkinson cycle, Miller cycle, etc.), a steam engine, or an air engine, each expansion chamber may be independently activated and deactivated according to the required power output of the device. For example, when low-power operation is suitable or desired, only the smallest expansion chamber or chambers may be activated, while larger amounts of power may be produced by using larger expansion chambers or combinations thereof, up to a maximum of all expansion chambers being activated for use in producing power. In operations where power requirements are highly variable, such as in motor vehicle operations that may include anything from idling to coasting or other low-powered operation, to hill-climbing, rapid acceleration, towing, or other high-powered applications, it is desirable to quickly adapt the operation of the piston-cylinder device to the situation.

Figure 9:
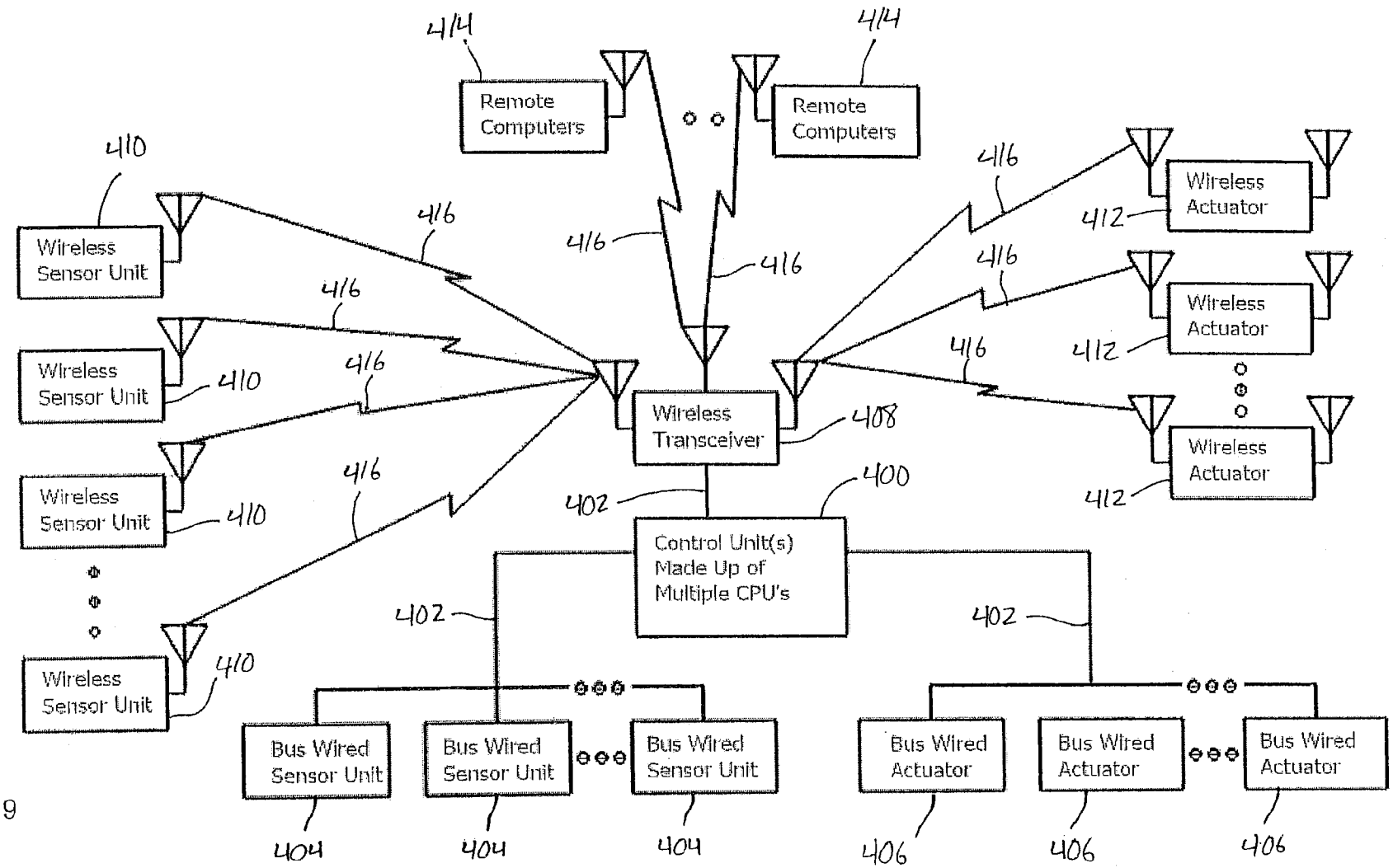
FIG. 9 is a schematic diagram of a sensor, controller, and actuator layout scheme, useful with the present invention.

As discussed above, individual expansion chambers can be activated by selectively opening and closing inlet valves 28*a-d* and outlet valves 30*a-d* of fluid inlets 24*a-d* and fluid outlets 26*a-d* of piston-cylinder device 10 (FIG. 1). Controller 400 may be electrically coupled, via wires 402, to wired sensors 404 (e.g. throttle position sensors) and/or to wired actuators 406 (e.g. valve actuators) (FIG. 9). Controller 400 may be coupled to a wireless transceiver 408 for sending and receiving signals to and from wireless sensor units 410, wireless actuators 412, and optionally, remote computers 414 (FIG. 9).

Because controller 400 is responsible for the timing, synchronization, and actuation characteristics (e.g. valve opening, closing, duration, travel distance, etc.) of the various parts and components of the piston-cylinder device of the present invention, it is desirable to minimize response time between the generation of a sensor signal (e.g. throttle position) and a responsive action (e.g. activation of a previously deactivated expansion chamber and/or activation of a direct fuel injector). For example, when a direct fuel injector (for injecting fuel directly into an expansion chamber) is to be activated, it may be required to inject multiple pulses of fuel at precise moments during the piston stroke. Thus, to minimize communication times between controller 400, sensors 414, 410 and actuators 406, 412, it is envisioned that Direct Memory Access (DMA) in controller 400, high speed buses (cables, fiber-optic lines, etc., such as wires 402), and/or high speed wireless connections 416 may be utilized.

For example, individual wired sensors 404 and actuators 406 may be attached to controller 400 via dedicated buses, shared buses, or combinations of dedicated or shared buses, while wireless sensors 410 and wireless actuators 412 may be in wireless communication with controller 400 via wireless transmission 416, or by a combination of wireless 406 and wired 402 transmission paths. By employing multiple methods of communication, controller 400 may select the fastest communication method at any given time, and permits redundancy of data paths so that the system may continue to operate even with one or more data paths disabled. For example, if a sensor signal arrives at controller 400 via two or more data paths, the controller may disregard "copies" of the signal that arrive after the fastest signal path delivers the signal. Remote computers 414 may be in wireless communication with controller 400 for exchanging data therewith. For example, remote computers 414 may be diagnostic computers, software update/upload computers, or high-level controllers of larger systems, of which controller 400 and its associated piston-cylinder device are only a part.

Controller 400 may be used to execute algorithms that consider input data 418 (FIG. 10) in order to select which expansion chambers should be activated or deactivated, or which chambers should be used for producing power and which should be used for other functions such as pumping or compressing fluids. Input data 418 may include, for example, fuel and/or fluid type, piston-cylinder device temperature, exhaust gas properties (temperature, chemical makeup, etc.), ambient temperature and humidity, barometric pressure, emissions, throttle position, chamber status (i.e. active or inactive), crank angle (i.e. crankshaft degree of rotation), engine speed, transmission speed, emission timing, valve timing, vehicle braking status, traction control status, etc.

Controller 400 may incorporate multiple high speed processors including chip "sets" that contain multiple CPU's (central processing units), with each CPU accessing its own Random Access Memory (RAM) or shared RAM, and is capable of sampling input data 418 at very high rates, such as one thousand samples per second or tens of thousands of samples per second. Optionally, controller 400 is capable of sampling input data 418 at hundreds of thousands of samples per second, such as to facilitate response times of $1/1000^{th}$ second. Exemplary processors that are currently available include, for example, the XEON® quad-core multi-core processor by Intel Corp. of Santa Clara, Calif., and the OPTERON® quad-core multi-core processor by Advanced Micro Devices, Inc. of Sunnyvale, Calif. High sampling rates permit controller 400 to adapt to the current conditions represented by input data 418 so that the activation, inactivation, and/or function (e.g. work-producing or pumping or compressing) can be nearly instantaneously adapted and changed as appropriate. In addition, an operator may wish to select between various settings for controller 400 that bias the controller toward a certain priority of operation, such as high-power, high-efficiency, cool operation, low emissions, or other desirable criteria.

Optionally, controller 400 is permanently installed or imbedded in the variable-displacement piston-cylinder device or multi-cylinder device, so that it cannot be removed, modified, or tampered with. In one embodiment, the controller would detect unauthorized attempts to tamper with or modify the controller, and would render itself inoperable in such an event. Further, the controller may include encryption technology to prevent hacking or unauthorized modifications, and may include battery backup. In addition, controller 400 may provide continuous diagnostic checking of all critical processes. In addition to processes directly related to operation of an engine, for example, the controller could monitor other systems, such as transmission, brakes, suspension, emissions, GPS or navigation data, cooling, safety systems, etc., such as in a motor vehicle. In addition, controller 400 may continuously transmit an electronic serial number to allow real-time tracking of its whereabouts. Controller 400 may adjust control parameters of critical processes, such as in response to wear, age, use cycles, and other effects upon operation of the variable-displacement piston-cylinder device. Operational data may be continuously logged and stored throughout the device's lifetime and stored in a hardened "black box" device to preserve the data in the event of an accident or mechanical or electrical shock or other damage.

Figure 12:
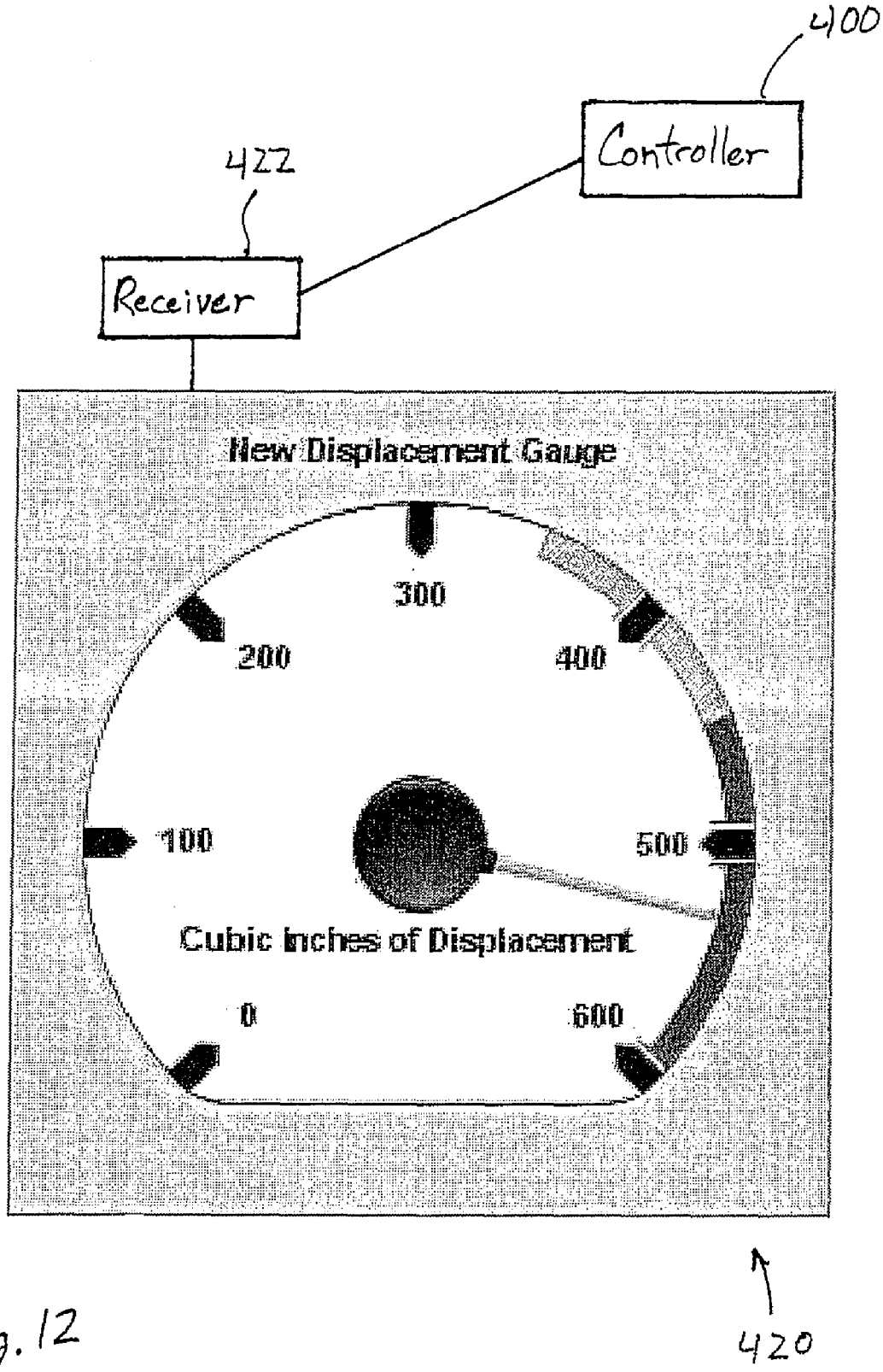
FIG. 12 is a displacement instrument useful with the present invention.

Optionally, controller 400 may be capable of wireless data transmission, such as Wi-Fi data transfer, for transferring data to an engine or vehicle-diagnostics device, and/or for loading changes or updates to the programming of the controller. Controller 400 may be configured to transmit environmental and location information to serve as a "sensor node" for a higher-level system such as weather monitoring and forecasting, and may be configured to transfer data to/from other "nodes" or similar controllers. By storing lifetime operational history, controller 400 may provide operational data to assist in diagnosing problems such as abnormal wear, malfunctions, and the like. Optionally, a displacement gauge 420 (FIG. 12) may be installed at a variable-displacement piston-cylinder device, or on a vehicle or apparatus incorporating such a device, in order to provide a visual indication of the current effective displacement of the device. Gauge 420 may continuously receive effective displacement data from controller 400, such as via a wired or wireless transmission to a receiver 422, and may be used by an operator to confirm the current working capacity of the piston-cylinder device.

Figure 10:
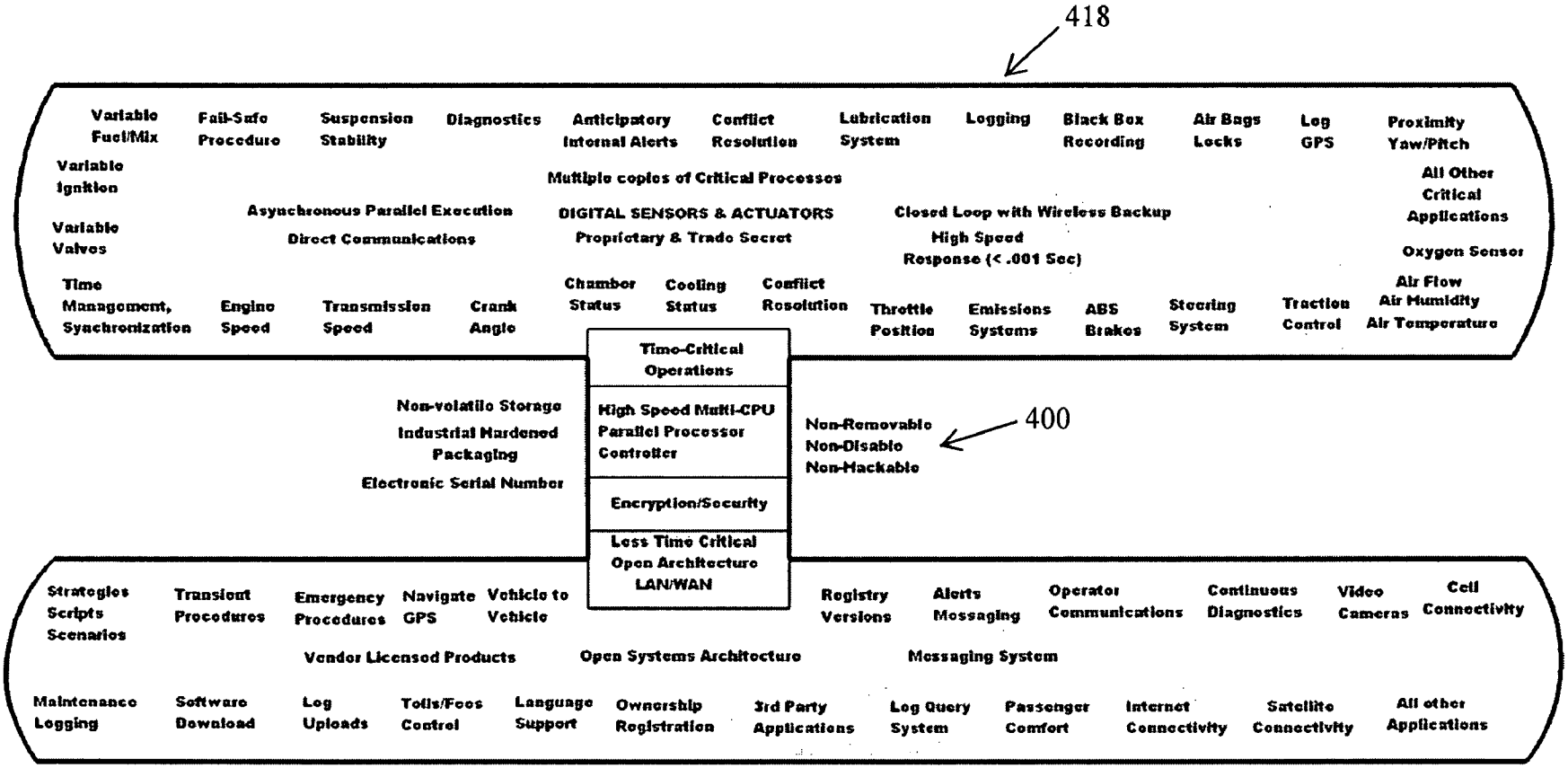
FIG. 10 is a diagram of a control system useful with the variable stacked piston device of the present invention.
Figure 11:
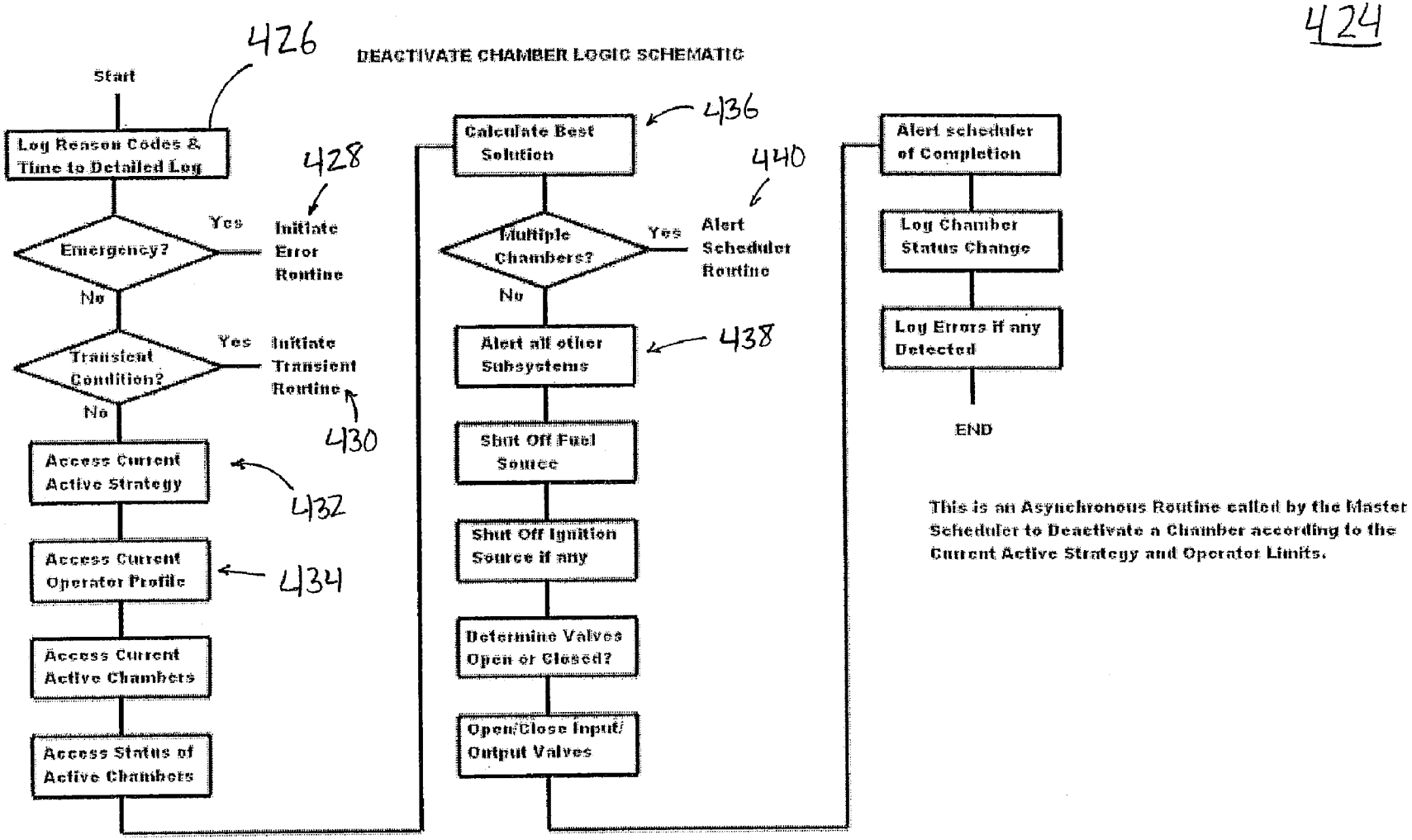
FIG. 11 is a schematic diagram and flow chart of a controller logic scheme.

In FIG. 11, a controller logic algorithm 424 summarizes one possible program or decision-process by which controller 400 may select which expansion chambers are activated or deactivated based on input data 418 (FIG. 10). Initially, controller 400 may log an initial data point 426 including function codes (such as, for example, an "active strategy," "transient mode," or "operator profile," as described below), date, time, etc. In the event that an abnormal operational condition exists, such as a problem with a sensor, an actuator, or software, an error routine 428 is initiated and controller 400 determines how to react to the error, such as by disabling an expansion chamber from further use until the problem is resolved. Next, a transient routine 430 may be initiated to handle transient conditions, such as cold starting or chamber cooling, for example, which are routines that are only expected to be active for a relatively short period of time before controller 400 reverts to a different routine such as a "normal" routine. Once the transient routine 430 is bypassed, controller 400 determines the current "active strategy" 432, in which controller 400 is directed to use a set of "rules" for operating the device. The active strategy 432 may be user-selectable, such as to bias the device toward maximum power output, or for fuel economy, or for emissions control, for example. Active strategy 432 may be preprogrammed, such as for an unmanned surveillance aircraft requiring a power-biased takeoff routine, an economy-biased cruising routine, and a speed-biased return or escape routine, for example. In addition, an operator profile 434 may be used to create operating limitations (e.g. speed, range, time, etc.) that may be applied to different operators or classes of operators who identify themselves or "log on" to the system.

Controller 400 then determines which expansion chambers are currently active and the purpose for which each active expansion chamber is being used, and calculates the optimum operational change 436 given the input data 418, active strategy 432, and operator profile 434. For example, operational change 436 may be warranted based on temperature, humidity, barometric pressure, current status of the device, and operator input (such as throttle position), in addition to current active strategy 432 and operator profile 434. Next, an "alert subsystems" routine 438 may be used to send a preparatory signal to other subroutines (e.g. chamber activation/deactivation routine) before a change is actually ordered, so that the subroutine being alerted has time to obtain sensor information or take other preparatory action before making a change, which enables very fast response times by using so-called "anticipatory actions."

Optionally, controller 400 may utilize "fuzzy logic" or "neural logic" to alter the operation of the variable-displacement piston-cylinder device under certain conditions. The envisioned logic scheme would monitor various parameters and order a change in the operating conditions of the piston-cylinder device when multiple parameters reach predetermined ranges, even though no single parameter is in a range that would, taken in isolation, warrant a change in device operating conditions.

A scheduler routine 440 coordinates actions between various subsystems. For example, for deactivating a chamber, this may involve shutting off a fuel source, shutting off spark ignition, and closing the valves that serve the particular cylinder. Controller 400 monitors the position of the pistons to ensure that scheduler routine 440 performs smooth transitions to new states of operation. For example, scheduler routine 440 may wait for one operation to be completed before another operation is begun. Optionally, the piston-cylinder device may be an "interference engine" in which valves could be struck by the piston if opened when the piston is at TDC, causing damage to the device if operational changes were not properly timed.

Single-chamber piston-cylinder devices generally exhibit low power at low engine speed, maximum power at a higher engine speed, and somewhat reduced power at a still higher engine speed (operating along or exhibiting a "power curve"). The variable-displacement piston-cylinder device of the present invention exhibits separate power curves for each expansion chamber of each device, such that the group of power curves may overlap one another within certain ranges. An engine of the present invention thus possesses more than one peak power capability, and can provide a corresponding peak efficiency at each of its power output levels rather than just one peak efficiency, as in a conventional single-displacement piston-cylinder device. Thus, different states of operation may be used to satisfy a desired output level, and the precise selection of chambers may be determined based upon active strategy 432, operating limits (such as according to operator profile 424), and environmental data. For example, it may be desirable to occasionally use a generally inactive expansion chamber in order to keep it near an operational temperature, or to spread wear more evenly across all piston sections and cylinder sections. In addition, one or more chambers may be used simply because a preferred chamber or combination of chambers has been disabled due to a perceived error, such as a stuck valve, inoperative ignition source, inoperative fuel injector, or the like.

Thus, the variable-displacement piston-cylinder device is operable to change its output capacity, in the form of power output or pumping or compressing capacity, during operation in order to tailor its performance to desired output, operating limitations, environmental factors, and other factors. In addition, the piston/cylinder device may be configured with two or more separate intake ports and exhaust ports at each expansion chamber, in order to change the function of each chamber between one of power production and fluid pumping or compressing. A controller samples all of the relevant available input data at a very high sampling rate so that the output of the device, and/or the type of work performed by the device, may be quickly and smoothly adjusted for optimum performance given a set of desired operating limitations and parameters.

Changes and modifications in the specifically described embodiments can be carried out without departing from the principles of the present invention, which is intended to be limited only by the scope of the appended claims, as interpreted according to the principles of patent law, including the doctrine of equivalents.

I claim:

1. A variable-displacement piston-cylinder device comprising:

a cylinder, said cylinder defining at least two generally cylindrical chambers in substantially coaxial arrangement and having different diameters;

an inlet at each of said at least two chambers, each of said inlets being adapted to selectively conduct a fluid into a respective one of said at least two chambers;

an outlet at each of said at least two chambers, each of said outlets being adapted to conduct a fluid out of the respective one of said at least two chambers;

a piston, said piston comprising at least two piston members joined to one another in substantially coaxial arrangement and having different diameters corresponding to the different diameters of said cylindrical chambers, wherein each of said at least two piston members is movably and reciprocally received in a respective one of said at least two chambers to define a displacement volume for each of said cylindrical chambers;

a controller, said controller being operable to select whether the fluid is conducted into either of said at least two chambers via said inlets; and wherein each of said at least two chambers is independently activatable and deactivatable by said controller selecting whether the fluid is conducted into either of said at least two chambers via said inlets.

2. The piston-cylinder device of claim 1, wherein said cylinder defines at least three generally cylindrical chambers having different diameters and said piston comprises at least three piston members.

3. The piston-cylinder device of claim 1, wherein said piston-cylinder device comprises at least one chosen from a combustion engine, a steam engine, an air engine, a fluid pump, or a fluid compressor.

4. The piston-cylinder device of claim 3, wherein said piston-cylinder device comprises a combustion engine and wherein the fluid comprises a combustible fluid.

5. The piston-cylinder device of claim 4, wherein said combustion engine comprises an ignition source at each of said chambers; and wherein said controller is operable to independently activate and deactivate each of said ignition sources.

6. The piston-cylinder device of claim 4, wherein said piston-cylinder device comprises a compression-ignition combustion engine.

7. The piston-cylinder device of claim 4, wherein said piston-cylinder device comprises a combustion engine and at least one chosen from a fluid pump and a fluid compressor.

8. The piston-cylinder device of claim 7, wherein at least one of said at least two generally cylindrical chambers comprises at least two of said inlets for conducting at least two different fluids into said at least one of said cylindrical chambers.

9. The piston-cylinder device of claim 8, wherein said at least one of said cylindrical chambers is operable as either a combustion engine or a fluid pump.

10. The piston-cylinder device of claim 9, wherein said controller is operable to change the operation of said at least one of said cylindrical chambers between operation as a combustion engine and operation as a fluid pump while said piston-cylinder device is operating.

11. The piston-cylinder device of claim 1, further comprising a valve at each of said inlets, each of said valves being independently operable by said controller to open and close a respective one of said inlets.

12. The piston-cylinder device of claim 1, wherein said displacement volume of each of said cylindrical chambers is approximately one unit volume larger or smaller than an adjacent one of said cylindrical chambers.

13. The piston-cylinder device of claim 1, wherein said displacement volume of each of said cylindrical chambers is approximately one-half the displacement volume and/or double the displacement volume of an adjacent one of said cylindrical chambers.

14. The piston-cylinder device of claim 1, further comprising:

at least two of said cylinders;

at least two of said pistons corresponding to said cylinders;

a connecting rod pivotally coupled to each of said pistons via a wrist pin;

a crankshaft, said crankshaft coupled to said pistons by said connecting rods; and wherein said controller is operable to simultaneously control the activation and deactivation of the respective chambers of each of said cylinders in a substantially identical manner so that each of said cylinders exhibits a substantially identical effective displacement.

15. A variable-displacement reciprocating combustion engine comprising:

a cylinder, said cylinder defining at least two generally cylindrical chambers in substantially coaxial arrangement and having different diameters;

an inlet at each of said at least two chambers, each of said inlets comprising a valve to selectively conduct a combustible fluid into a respective one of said at least two chambers;

an outlet at each of said at least two chambers, each of said outlets comprising a valve to selectively conduct a fluid out of the respective one of said at least two chambers;

a piston, said piston defining at least two piston members joined to one another in substantially coaxial arrangement and having different diameters corresponding to the different diameters of said cylindrical chambers, wherein each of said at least two piston members is movably and reciprocally received in a respective one of said at least two chambers to define a displacement volume for each of said cylindrical chambers;

a controller, said controller being operable to select whether the fluid is conducted into either of said at least two chambers via said inlets; and wherein each of said at least two chambers is independently activatable and deactivatable by said controller selecting whether the combustible fluid is conducted into either of said at least two chambers via said inlets.

16. The combustion engine of claim 15, further comprising an ignition source at each of said chambers, each of said ignition sources being independently energizable by said controller, wherein each of said at least two chambers is independently activatable and deactivatable by said controller selecting which of said ignition sources is energized to cause combustion of said fluid.

17. The combustion engine of claim 15, wherein said combustion engine comprises a compression-ignition engine.

18. The combustion engine of claim 17, further comprising an ignition source at least one of said chambers, each of said ignition sources being independently energizable by said controller to cause combustion of said fluid.

19. The combustion engine of claim 18, wherein said at least one generally cylindrical chamber comprising said ignition source exhibits a different compression ratio than the other generally cylindrical chambers.

20. The combustion engine of claim 19, wherein at least one generally cylindrical chamber comprising said ignition source is operable on a different combustible fluid than the other generally cylindrical chambers.

21. The combustion engine of claim 15, wherein each of said at least two chambers is further independently activatable and deactivatable by said controller selecting whether the combustible fluid is conducted out of either of said at least two chambers via said outlets.

22. The combustion engine of claim 15, wherein said cylinder defines at least three generally cylindrical chambers having different diameters and said piston comprises at least three piston members.

23. The combustion engine of claim 22, wherein said cylinder defines at least four generally cylindrical chambers having different diameters and said piston comprises at least four piston members.

24. The combustion engine of claim 15, wherein said controller receives chamber status data and throttle position data to select which of said at least two chambers to independently activate or deactivate.

25. The combustion engine of claim 24, wherein said controller receives data chosen from at least one of fuel type, engine temperature, exhaust gas properties, ambient temperature, ambient humidity, barometric pressure, emissions, crankshaft angle, engine speed, transmission speed, emission timing valve timing, vehicle braking status, traction control status, brakes status, suspension status, navigational data, safety systems status, active strategy, transient mode, or operator profile.

26. The combustion engine of claim 15, wherein said displacement volume of each of said cylindrical chambers is approximately one unit volume larger or smaller than an adjacent one of said cylindrical chambers.

27. The combustion engine of claim 15, wherein said displacement volume of each of said cylindrical chambers is approximately one-half the displacement volume and/or double the displacement volume of an adjacent one of said cylindrical chambers.

28. The combustion engine of claim 15, comprising:

at least two of said cylinders;

at least two of said pistons corresponding to said cylinders;

a connecting rod pivotally coupled to each of said pistons via a wrist pin;

a crankshaft, said crankshaft being rotatably drivable by said connecting rods in response to reciprocating motion of said pistons; and wherein said controller is operable to simultaneously control the activation and deactivation of the respective chambers of each of said cylinders in a substantially identical manner so that each of said cylinders exhibits a substantially identical power output.

29. A method of controlling a variable-displacement piston-cylinder device, said method comprising:

providing a cylinder defining at least two generally cylindrical chambers in substantially coaxial arrangement and having different diameters;

providing a piston comprising at least two piston members joined to one another in substantially coaxial arrangement and having different diameters corresponding to the different diameters of said cylindrical chambers;

providing a controller;

positioning the piston in the cylinder so that each of the piston members is movably and reciprocally received in a respective one of the chambers to define a displacement volume for each of the cylindrical chambers;

independently controlling, via the controller, fluid flow through fluid inlets to any single cylindrical chamber or combination of the cylindrical chambers; and independently controlling, via the controller, fluid flow through the outlets out of any single cylindrical chamber or combination of the cylindrical chambers.

30. The method of claim 29, further comprising providing a combustible fluid to at least one of the generally cylindrical chambers.

31. The method of claim 30, further comprising:

operating the at least one of the generally cylindrical chambers receiving the combustible fluid as a combustion engine; and operating another of the generally cylindrical chambers as a fluid pump or compressor.

32. The method of claim 30, further comprising:

providing an ignition source at the at least one of the generally cylindrical chambers receiving the combustible fluid as a combustion engine; and controlling the ignition source via the controller.

33. The method of claim 29, wherein said independently controlling fluid flow through fluid inlets comprises opening and closing valves in the fluid inlets, and wherein said independently controlling fluid flow through the outlets comprises opening and closing valves in the fluid outlets.

* * * * *

UNITED STATES PATENT AND TRADEMARK OFFICE

CERTIFICATE OF CORRECTION

PATENT NO. : 7,779,627 B1
APPLICATION NO. : 12/366295
DATED : August 24, 2010
INVENTOR(S) : James D. Ries It is certified that error appears in the above-identified patent and that said Letters Patent is hereby corrected as shown below:

Column 2
Line 31, Delete ";" after --aspect--
Line 40, Delete ";" after --strategy--

Column 6
Line 1, Delete ";" after --16d--

Column 9
Line 12, Insert --form-- after "the"

Column 12
Line 42, "operable" should be --openable--

Column 18
Claim 5, Line 51, ";" should be --,--

Column 20
Claim 18, Line 2, Insert --at-- after "at"

Signed and Sealed this
Fifteenth Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,779,627 B1
APPLICATION NO. : 12/366295
DATED : August 24, 2010
INVENTOR(S) : Ries It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 7 days.

Signed and Sealed this
Twenty-first Day of June, 2011

David J. Kappos

David J. Kappos
*Director of the United States Patent and Trademark Office*